US009888529B2

(12) United States Patent
Hirota

(10) Patent No.: US 9,888,529 B2
(45) Date of Patent: Feb. 6, 2018

(54) INDUCTION HEATING DEVICE FOR A METAL PLATE

(75) Inventor: Yoshiaki Hirota, Futtsu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 2602 days.

(21) Appl. No.: 11/884,313

(22) PCT Filed: Feb. 9, 2006

(86) PCT No.: PCT/JP2006/002676

§ 371 (c)(1),
(2), (4) Date: Aug. 14, 2007

(87) PCT Pub. No.: WO2006/088068

PCT Pub. Date: Aug. 24, 2006

(65) Prior Publication Data

US 2010/0155390 A1 Jun. 24, 2010

(30) Foreign Application Priority Data

Feb. 18, 2005 (JP) ..... 2005-41944
Sep. 5, 2005 (JP) ..... 2005-256334

(51) Int. Cl.
*H05B 6/10* (2006.01)
*H05B 6/40* (2006.01)
*H05B 6/36* (2006.01)

(52) U.S. Cl.
CPC ..... *H05B 6/104* (2013.01); *H05B 6/362* (2013.01)

(58) Field of Classification Search
CPC ..... H05B 6/362; H05B 6/104
(Continued)

(56) References Cited

U.S. PATENT DOCUMENTS 2,448,009 A 8/1948 Baker
2,897,328 A 7/1959 Alf et al.
(Continued)

FOREIGN PATENT DOCUMENTS

DE 18 03 129 A1 4/1970
GB 932602 7/1963
(Continued)

OTHER PUBLICATIONS

Office Action in Canadian Application No. 2,597,529 dated Aug. 12, 2010.
Japanese Office Action, dated Jul. 27, 2010, for Japanese Application No. 2006-041678, with English language summary.
Brazilian Office Action and Search Report issued in Brazilian Application No. PI0607428-6 dated Aug. 22, 2017, together with an English translation.

*Primary Examiner* — Quang Van
(74) *Attorney, Agent, or Firm* — Birch, Stewart, Kolasch & Birch, LLP

(57) ABSTRACT

An induction heating apparatus for heating a traveling metal plate includes an induction coil for surrounding the metal plate. The induction coil includes an upper portion for being located above the metal plate and a lower portion for being located below the metal plate. The upper and lower portions of the induction coil are spaced from each other in a longitudinal direction of the metal plate at least at one position in a transverse direction of the metal plate. The distance in the longitudinal direction of the metal plate between the upper portion and the lower portion of the induction coil varies across a transverse direction of the metal plate.

6 Claims, 20 Drawing Sheets

*1 ARROW REPRESENTS CURRENT DIRECTION
*2 BOLD LINE REPRESENTS UPPER INDUCTION COIL CONDUCTOR LOCATED ABOVE A METAL PLATE TO BE HEATED
FINE LINE REPRESENTS LOWER INDUCTION COIL CONDUCTOR LOCATED BELOW A METAL PLATE TO BE HEATED

(58) Field of Classification Search
USPC ..... 219/645, 634, 653, 672, 673, 635, 639, 219/662, 646, 670; 118/639, 725, 500, 118/715, 730, 732
See application file for complete search history.

(56) References Cited

U.S. PATENT DOCUMENTS

| | | | | | |
|---|---|---|---|---|---|
| 3,031,555 | A | | 4/1962 | Ross et al. | |
| 4,258,241 | A | * | 3/1981 | Soworowski | 219/656 |
| 4,300,031 | A | * | 11/1981 | Reboux et al. | 219/617 |
| 4,751,360 | A | | 6/1988 | Ross et al. | |
| 4,778,971 | A | | 10/1988 | Sakimoto et al. | |
| 4,788,396 | A | * | 11/1988 | Maugein et al. | 219/645 |
| 5,336,868 | A | | 8/1994 | Schluckebier et al. | |
| 5,582,790 | A | | 12/1996 | Ferry et al. | |

FOREIGN PATENT DOCUMENTS

| | | | |
|---|---|---|---|
| GB | 1015258 | | 12/1965 |
| JP | 51-41233 | | 10/1976 |
| JP | 63-252382 | A | 10/1988 |
| JP | 4-147596 | A | 5/1992 |
| JP | 11-61277 | A | 3/1999 |
| JP | 2002-43042 | A | 2/2002 |
| JP | 2002-151245 | A | 5/2002 |
| JP | 2003-187950 | A | 7/2003 |
| JP | 2004-296368 | A | 10/2004 |
| JP | 2005-209608 | A | 8/2005 |

* cited by examiner

*1 ARROW REPRESENTS CURRENT DIRECTION
*2 BOLD LINE REPRESENTS UPPER INDUCTION COIL CONDUCTOR LOCATED ABOVE A METAL PLATE TO BE HEATED
FINE LINE REPRESENTS LOWER INDUCTION COIL CONDUCTOR LOCATED BELOW A METAL PLATE TO BE HEATED

ARROW REPRESENTS
COIL CURRENT DIRECTION

ARROW REPRESENTS
COIL CURRENT DIRECTION

INDUCTION HEATING DEVICE FOR A METAL PLATE

CROSS-REFERENCE TO RELATED APPLICATIONS

This nonprovisional application claims priority under 35 U.S.C. § 119(a) on Patent Applications Nos. 2005-41944 and 2005-256334, filed in Japan on Feb. 18, 2005 and Sep. 5, 2005 respectively. The entirety of each of the above documents is incorporated herein by reference.

BACKGROUND OF THE INVENTION

1. Field of the Invention

The present invention relates to an induction heating apparatus for a metal plate such as a steel plate or an aluminum plate. The present invention particularly relates to an induction heating apparatus that heats a metal plate by generating an induced current therein using an induction coil surrounding the metal plate. The present invention also relates to an induction heating apparatus, which is capable of heating a metal plate with high efficiency irrespective of a thickness of the metal plate and irrespective of whether the metal plate is magnetic or non-magnetic. The present invention is further related to an induction heating apparatus, which can control a temperature distribution in the lateral (width) direction of the metal plate irrespective of a preexisting temperature distribution before heating to form a metal plate with a more uniform temperature distribution after heating.

2. Description of the Related Art

An indirect heating apparatus using gas or electricity, or a direct heating apparatus using induction heating has been used for heating a metal plate to control the quality of the metal material in the heat-treatment process. Since a direct heating apparatus has no thermal inertia, unlike an indirect heating apparatus, a direct heating apparatus can save the time which is required by an indirect heating apparatus to reach a stable furnace temperature, and can easily control the heating rate, for example, when a thickness of plate is changed. Therefore, a direct heating apparatus does not require changing of the metal plate transportation speed, which prevents productivity from being lowered.

There are two types of induction heating apparatus for a metal plate. One type is an LF type (Longitudinal Flux type), in which a metal plate is heated by generating a circular induced current therein in the cross-section using an induction coil, where an alternate current with a frequency ranging normally from 1 KHz to 500 KHz is applied, surrounding the metal plate. FIG. 1 shows a schematic diagram of an LF type induction heating apparatus. FIG. 2 illustrates a circular induced current generated in the cross-section using an LF type induction heating apparatus. In FIG. 1, an induction coil 2 connected to an AC power supply 3 surrounds a metal plate 1. When a primary current 5 is passed through the induction coil 2, a flux 4 penetrates the metal plate 1 to generate an induced current around the flux 4. In FIG. 2, an induced current 6 generated in the cross-section of the metal plate 1 flows in an opposite direction to the primary current 5 running through the induction coils 2 which are located above and under the metal plate 1, respectively. The other type is a TF type (Transverse Flux type), in which induction coils with a core are located above and under the metal plate respectively. When an AC power supply to the coils is turned on, a flux penetrates the metal plate between the cores in the plate thickness direction to generate an induced current, which leads to heating of the metal plate.

In TF type heating, the induced current concentrates on a lateral end area of the metal plate and at the same time the current density in the vicinity of the end area is lowered, which easily causes a non-uniform temperature distribution in a lateral direction after heating. In particular, it becomes more difficult to provide a uniform heating when the positional relationship between the core of the induction coil and the metal plate is changed by shifting a width of the metal plate or by a snaking of the metal plate. In the background art, a technology that uses a rhombus-shaped coil was proposed so that the flux can always penetrate over an entire width of the plate by tilting the rhombus-shaped coil when the width of the metal plate is changed. However, because this technology uses leakage flux from the induction coil, it requires the metal plate and the induction coil to be close to each other. In addition, installation of a rotation mechanism on the induction heating apparatus where a large amount of current is supplied increases the difficulty in carrying out the technology on industrial scale.

The LF type heating is a method for heating a metal plate surrounded by an induction coil, which can make sure that a circular induced current is generated in the metal plate so as to heat the plate. An induced current that is generated in the cross-section of the metal plate in an LF type is concentrated at the depth "d" expressed in the following expression:

$$d[\mathrm{mm}]=5.03\times10^{+5}\times(\rho/\mu r f)^{-0.5} \quad (1)$$

where d is the induced current penetration depth [mm], ρ is the specific resistance [Ωm], μr is the relative magnetic permeability, and f is the frequency [Hz] for heating.

An induced current penetration depth increases as a temperature of the metal increases because the specific resistance increases when the temperature of the metal increases. The relative magnetic permeability of ferromagnetic material or paramagnetic material decreases as the temperature becomes closer to the Curie point, and finally becomes 1 at a temperature above the Curie point. This means that the induced current penetration depth increases as the temperature increases. Since the relative magnetic permeability of a non-magnetic material is 1, its induced current penetration depth is larger compared to that of a magnetic material.

In LF type induction heating, if the induced current penetration depth is large and yet a thickness of the metal plate is thin, the induced current generated in an upper portion of the metal and the induced current generated in a lower portion of the metal cancel each other. This leads to heating that has a low efficiency.

For example, if a heating frequency of 10 KHz is used, the induced current penetration depth at room temperature is about 1 mm with aluminum of non-magnetic material, about 4.4 mm with stainless steel 304 (SUS304) and about 0.2 mm with steel of magnetic material. The current penetration depth of steel at temperature above the Curie point (at about 750° C.) is about 5 mm. Most steel plates for automobiles and home electric appliances, which are major commercial products that use metal plates, have a thickness of not more than 2 mm. Therefore, it is usually difficult to heat such metal plate with high efficiency without the induced currents in the upper and lower portions of the metal plate being canceled as mentioned above. It could be thought to increase the frequency of the AC current supplied to the LF type induction heating apparatus to several hundred KHz in order to make the depth of the induced current penetration shallower, so that canceling the induced currents can be avoided; however, it is not very practical to use a large current power source with such a high frequency on an industrial scale.

It has been proposed to use an induction heating apparatus that uses an induction coil surrounding a metal plate, which is capable of heating a metal plate with high efficiency even if the metal plate is at a high temperature and/or is a thin metal plate. In such induction heating apparatus, an induction coil located above the metal plate (upper induction coil) and another induction coil located below the metal plate (lower induction coil) are arranged parallel to each other, so as to be set respectively in different positions in a longitudinal direction of the metal plate. In other words, two projected images of the upper induction coil and the lower induction coil, which are respectively formed by vertically projecting the two induction coils onto the metal plate, are parallel to each other and in a different position in the longitudinal direction of the metal plate.

FIG. 3 is a schematic diagram of the above-mentioned induction heating apparatus where an induction coil 2*a* located above the metal plate 1 (upper induction coil) and another induction coil 2*b* located below the metal plate 1 (lower induction coil) are arranged parallel to each other and in a different position in the longitudinal direction of the metal plate. Reference numerals 7 and 8 represent a conductive member and an AC power supply 8, respectively. FIGS. 4A and 4B show the flow of the induced current in the metal plate 1 when the upper induction coil and the lower induction coil are arranged in a different position in the longitudinal direction of the metal plate. FIG. 4A is a schematic diagram illustrating the state of the induced current viewed from above the metal plate. FIG. 4B is a cross-sectional view taken on the line 4B-4B of FIG. 4A. Reference numeral 10 in FIG. 4A represents the flow of the induced current. When the upper induction coil and the lower induction coil are arranged so as to be set in a different position in the longitudinal direction of the metal plate, the upper path and the lower path of the circular induced current generated in the metal plate are also arranged to be set respectively in, different positions in the longitudinal direction of the metal plate. Therefore, it makes it possible to heat the metal plate with high efficiency without cancellation of the induced currents in the upper and lower portions in the metal plate while the induced current penetration depth is large, even where the temperature of the metal plate is high and/or the metal plate is thin.

However, in the use of such an induction heating apparatus where the upper and lower induction coils are set in different positions in the longitudinal direction of the metal plate, an edge area of the metal plate in the width direction can become overheated compared to a central area of the metal plate in the width direction. This can result in a non-uniform temperature distribution as a finishing temperature in the transverse direction of the metal plate.

This phenomenon is experienced because a width of the induced current path in the edge area of the metal plate (corresponding to "d2" in FIG. 4*a*), where the current flows from an upper portion to a lower portion in the metal plate, is narrower than the induced current path in the Upper and lower portions of the metal plate (corresponding to "d1" in FIG. 4A). Therefore, a current density in the edge area of the metal plate is higher than a current density in the central area. One reason for narrowing the current path in the edge area is that the current flowing in the edge area is to be shifted toward edge, so that the inductance between the induced current flowing in the edge area in the metal plate thickness direction and the primary current flowing through the induction coil arranged near the edge of the metal plate in the metal plate thickness direction can be lowered. Another reason for the overheating at the edge area is that the heating time at the edge area of the metal plate (defined as d3/(the traveling speed of the metal plate), where d3 is defined as in FIG. 4A) is longer than the heating time at the central area (defined as d1/(the traveling speed of the metal plate), where d1 is defined as in FIG. 4*a*).

In the use of such an induction heating apparatus where upper and lower induction coils are set in different positions in a longitudinal direction of the metal plate, if the temperature at the edge area is lower than that, of the central area of the metal plate before starting the induction heating, non-uniformity in the temperature distribution can be reduced after the induction heating. However, if the temperature distribution is uniform or the temperature at the edge area is higher than that of the central area because of a previous process, a non-uniform temperature distribution in the width direction will be obtained after the induction heating.

SUMMARY OF THE INVENTION

An object of the present invention is to solve some or all of the problems of the conventional induction heating apparatus mentioned above. An embodiment of the present invention is capable of heating a metal plate with high efficiency, even where the temperature of the metal plate is high above the Curie point, the metal plate is thin and/or the metal plate is made of a non-magnetic, non-ferrous metal with a low specific resistance such as aluminum or copper. In addition, an embodiment of the present invention is capable of providing a metal plate with a more uniform temperature distribution in the width direction, independent of the temperature distribution provided by a previous process. An embodiment of the present invention can make it easier to realize a desired temperature distribution, even when the width of the metal plate to be heated is changed, without preparing a plurality of induction coils to cope with the change in the width of the metal plate. An embodiment of the present invention can also improve a non-uniform temperature distribution caused by snaking of the metal plate. Another embodiment of the present invention provides a technology that has a great flexibility in the distance between the upper and lower induction coils, the width of the induction coils and the heat release value in the longitudinal direction of a metal plate.

The above objects of the present invention can be accomplished by an induction heating apparatus for heating a traveling metal plate, comprising: an induction coil for surrounding the metal plate, said induction coil including an upper portion for being located above the metal plate and a lower portion for being located below the metal plate, said upper and lower portions of the induction coil being spaced from each other in a longitudinal direction of the metal plate at least at one position in a transverse direction of the metal plate, wherein a distance in the longitudinal direction of the metal plate between the upper portion and the lower portion of the induction coil varies across a transverse direction of the metal plate.

The above objects of the present invention can also be accomplished by an induction heating apparatus for heating a traveling metal plate, comprising: an induction coil having an upper portion for being located above the metal plate and a lower portion for being located below the metal plate, said upper and lower portions of the induction coil being spaced from each other in a longitudinal direction of the metal plate at least at one position in a transverse direction of the metal plate; and an AC power source, each of the upper and lower portions of the induction coil being connected at one end thereof to the AC power source, wherein a distance in the longitudinal direction of the metal plate between the upper portion and the lower portion of the induction coil varies across a transverse direction of the metal plate.

In the present invention, the meaning of a traveling metal plate is not limited to a metal plate traveling in one direction, but includes a reciprocating movement of the metal plate.

In the present invention, an induction coil is a collective term that includes a coil formed by a tube, a wire, a plate or the like of an electric conductive material surrounding a metal plate by a single turn or more. In addition, surrounding of the metal plate is not limited to a specific form such as circular or square. With regard to the materials for the electric conductor, non-magnetic and low resistance materials such as copper, copper alloy or aluminum are preferable.

With regard to the metal plate of the present invention, a magnetic material such as steel, non-magnetic materials such as aluminum or copper and steel in a non-magnetic state at a temperature above the Curie point can be used.

In the present invention, the traverse direction of the metal plate means a direction perpendicular to a traveling direction of the metal plate, and the longitudinal direction of the metal plate means the traveling direction of the metal plate. For clarity, the traveling direction of which the metal plate travels is referred to as a conveyance path.

In the present invention, an edge of the metal plate is an end of the metal plate in a transverse direction. An edge area of the metal plate is the upper (top) of lower (bottom) surface of the metal plate close to or in the vicinity of the edge of the metal plate.

In the present invention, the width of an induction coil means a width of the induction coil in the longitudinal direction of the metal plate.

In the present invention, a distance in the longitudinal direction between the induction coil located above the metal plate and the induction coil located below the metal plate is defined as a distance between the two projected images of the induction coil located above and located below the metal plate, which are respectively formed by vertically projecting each induction coil onto the metal plate. The distance in the longitudinal direction between the induction coils defines a first and second edge of a conveyance area through which the metal sheet passes. Third and fourth edges of the conveyance area coincide with the edges of the metal sheet 1.

FIG. 5 is a schematic diagram of the cross-section of an induction heating apparatus of the present invention in a longitudinal direction of a metal plate to be heated. Reference numeral 1 represents a cross-sectional view of a metal plate extended in its longitudinal direction, Reference numeral 2*a* represents a cross-sectional view of an induction coil located above the metal plate 1, reference numeral 2*b* represents a cross-sectional view of an induction coil located below the metal plate 1, reference numeral 30*a* represents a vertically projected image of the induction coil located above the metal plate 1, and reference numeral 30*b* represents a vertically projected image of the induction coil located below the metal plate 1.

Hereinafter "an induction coil located above the metal plate" may be referred to as an "upper portion of the induction coil" or simply an "upper induction coil," and "an induction coil located below the metal plate" may be referred to as a "lower portion of the induction coil" or simply a "lower induction coil."

A distance in the longitudinal direction between the upper and lower induction coils is defined as "L" in FIG. 5.

In the case where a width of the upper induction coil and a width of the lower induction coil are different, a starting point to determine the distance "L" is an edge (end) of the vertically projected image of the wider induction coil.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention will now be described with reference to the accompanying drawings. All of the drawings illustrate a single turn of the induction coil surrounding a metal plate. However, the number of turns of the induction coil in the present invention is not limited to specific number.

Figure 1:
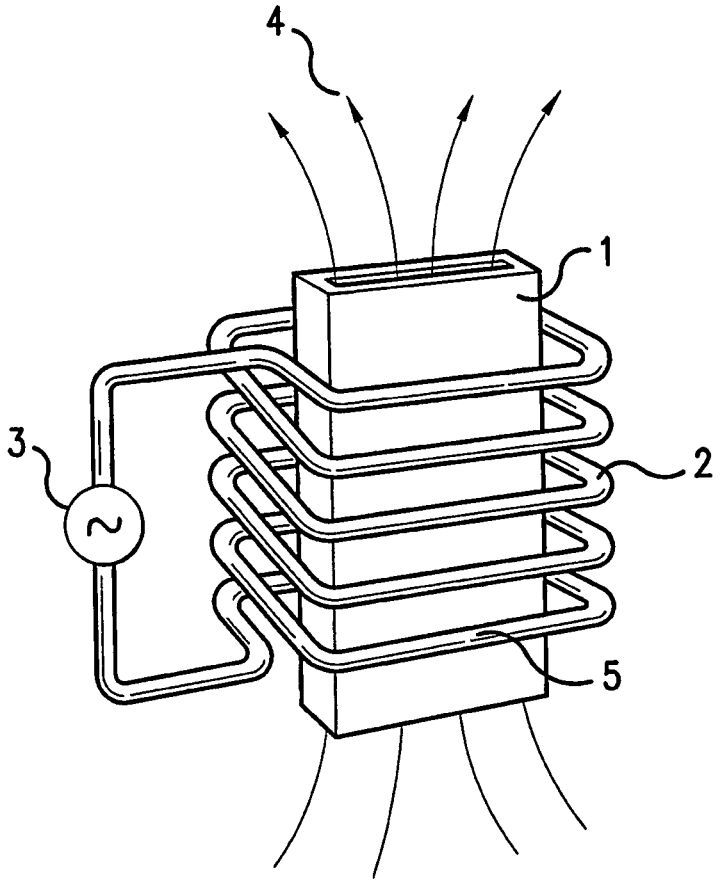
FIG.1 BACKGROUND ART
FIG. 1 is a schematic diagram of an LF type induction heating apparatus according to the background art.
Figure 2:
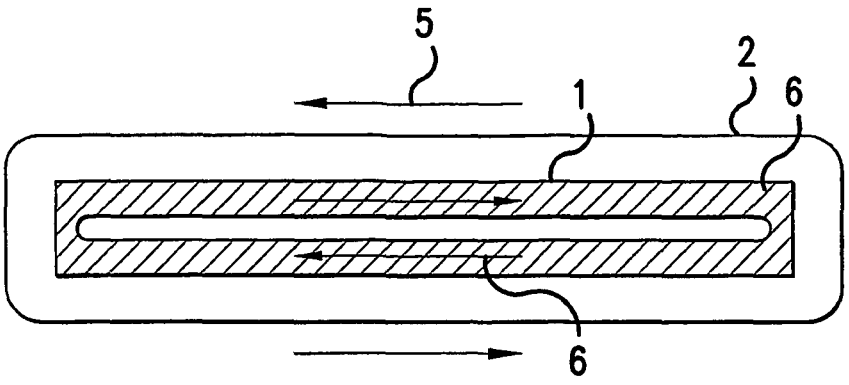
FIG.2 BACKGROUND ART
FIG. 2 illustrates a circular induced current generated in the cross-section of the metal plate of FIG. 1.
Figure 3:
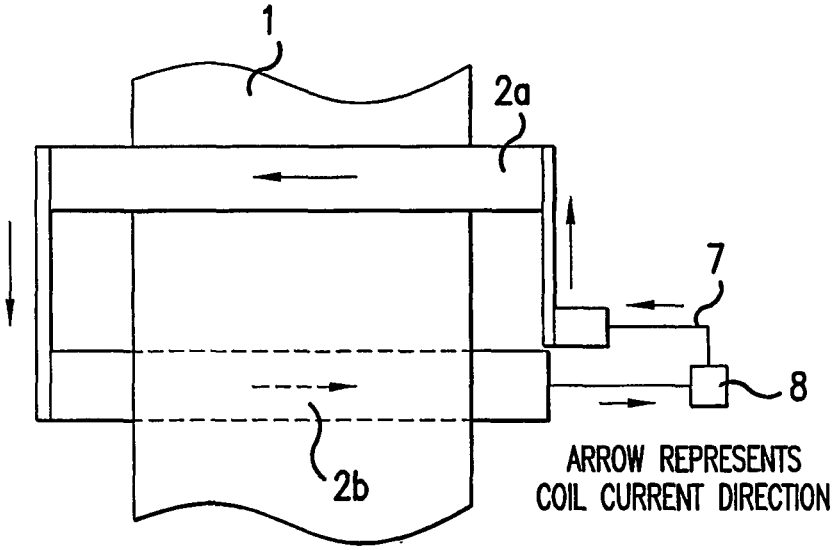
FIG.3 BACKGROUND ART
FIG. 3 is a schematic diagram of an induction heating apparatus according to the background art.
Figure 4A:
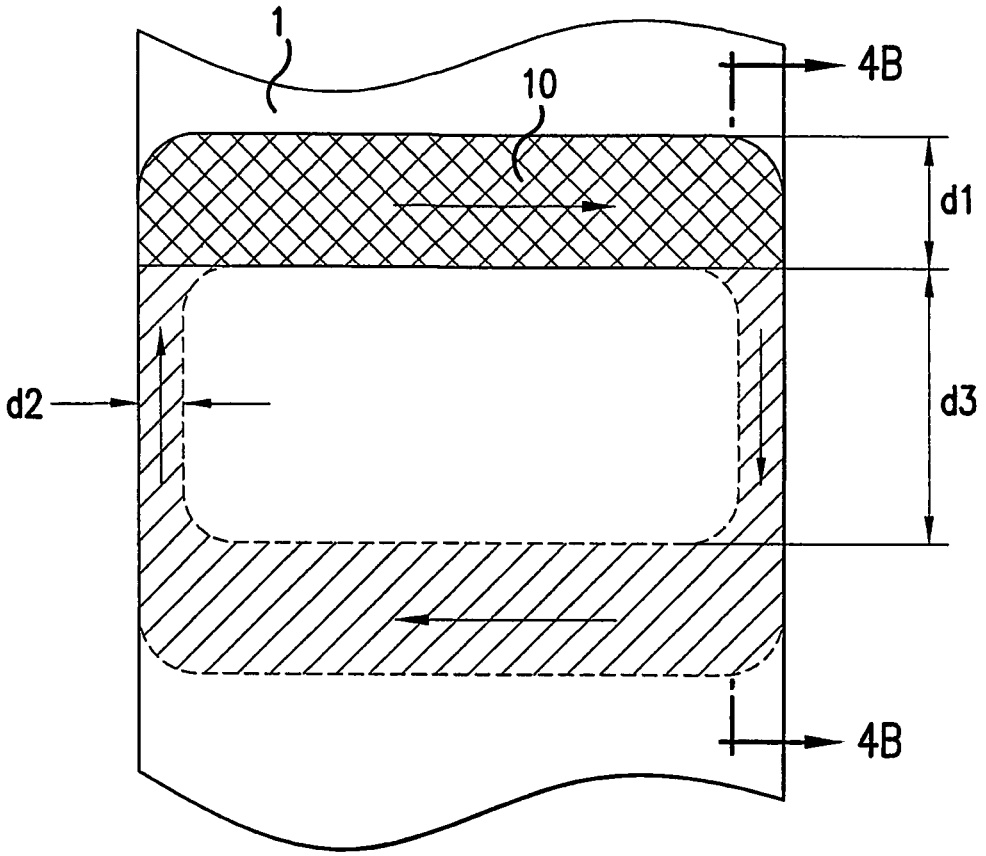
FIG.4A BACKGROUND ART
FIG. 4A is a schematic diagram illustrating the state of an induced current flow in a metal plate viewed from above the metal plate.
Figure 4B:
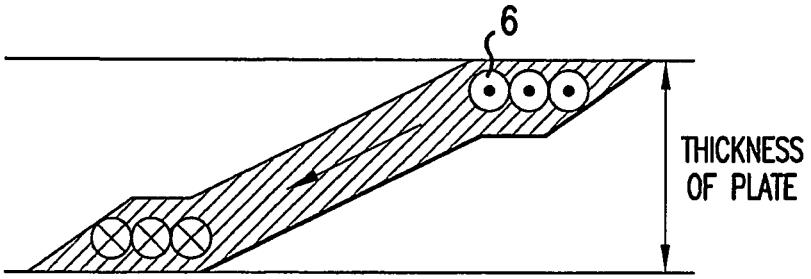
FIG.4B BACKGROUND ART
FIG. 4B is a cross-sectional view taken on the line 4B-4B of FIG. 4A.
Figure 5:
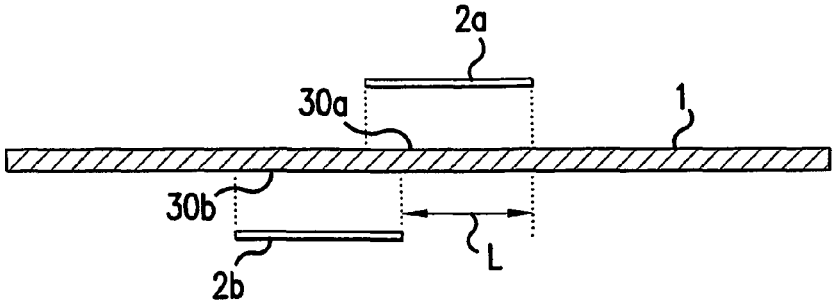
FIG. 5 is an explanatory diagram that defines a distance between upper and lower induction coils in the present invention.
Figure 6:
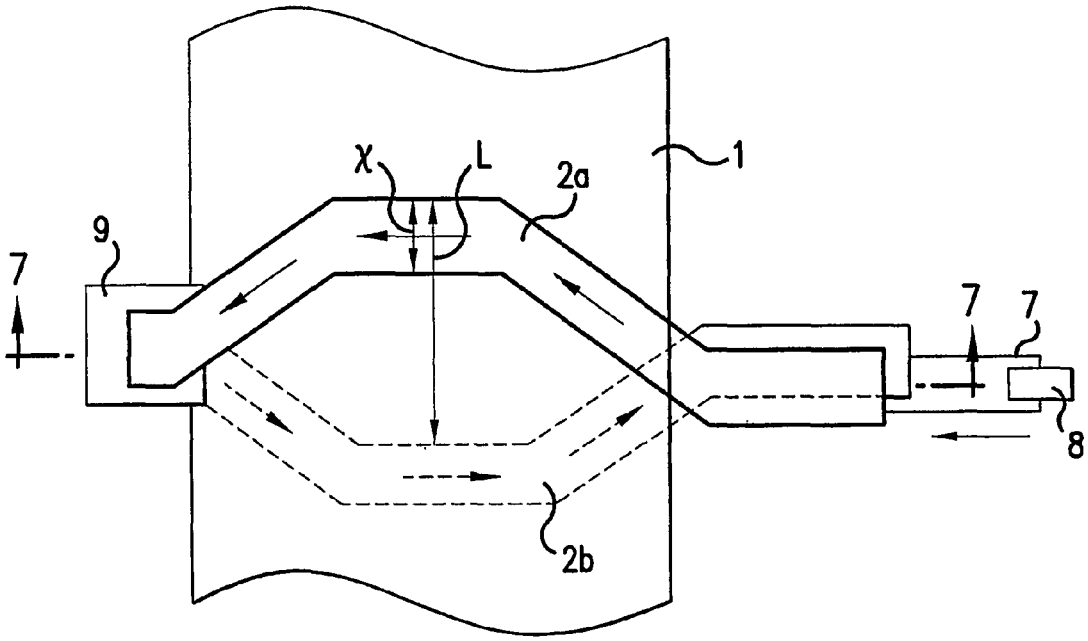
FIG. 6 is a schematic diagram of an embodiment of the present invention.
Figure 7:
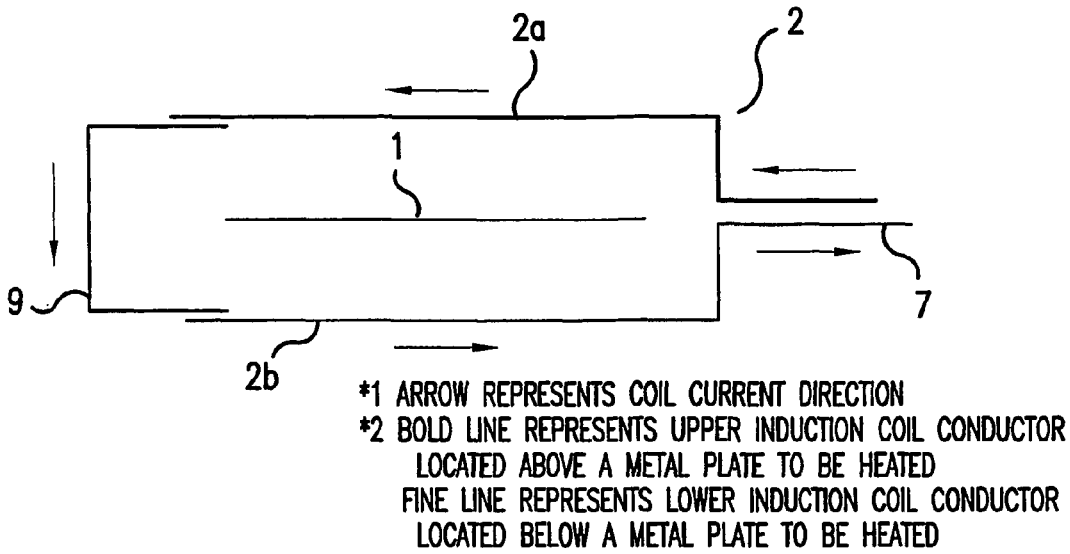
FIG. 7 is a schematic diagram of cross-sectional view taken on line 7-7 of FIG. 6.

FIG. 6 is a plane view schematic diagram of an example of an induction heating apparatus of the present invention. FIG. 7 is schematic diagram of a cross-sectional view taken on line 7-7 of FIG. 6. In the present invention, an induction coil located above the metal plate and another induction coil located below the metal plate are located so as to be away from each other in the longitudinal direction of the metal plate at least at one position in the traverse direction of the metal plate. A distance between the upper induction coil and the lower induction coil being away from each other in the longitudinal direction is defined as a distance between the two projected images of the upper induction coil and the lower induction coil, which are respectively formed by vertically projecting each induction coil onto the metal plate. The distance between the upper and lower induction coils can vary at different positions in the traverse direction at least one portion of the longitudinal direction. In FIG. 6, an upper induction coil 2*a* and a lower induction coil 2*b* have specific bent shapes so that the distance between the upper and lower induction coils can become smaller at edge area than at a central area in the traverse direction. Reference numeral 7 represents a conductive member, 8 represents an AC power supply and 9 represents an induction coil located close to the edge (end) of the metal plate. In addition, reference symbol x represents a width of the induction coil in the longitudinal direction of the metal plate at a central area in the traverse direction of the metal plate and reference symbol L represents a distance between the upper and lower induction coils at the central area.

When the upper induction coil and the lower induction coil are located so as to be away from each other in the longitudinal direction of the metal plate, in particular at the central area shown in FIG. 6, the upper and lower paths of the circular induced current generated in the metal plate are also arranged to be away from each other in the longitudinal direction of the metal plate. Therefore, it makes it possible to heat the metal plate with high efficiency without cancellation of the induced currents in the upper and lower portions of the metal plate while the induced current penetration depth is large, even where the temperature of the metal plate is high and/or the metal plate is thin.

A maximum distance between the upper and lower induction coils (In FIG. 6, it corresponds to distance L at the central area) can be determined based on the material of metal plate, the temperature of metal plate, the width of the induction coil and the width of the metal plate. In order to effectively heat a steel sheet after cold rolling in a non-magnetic region at a temperature above the Curie point, it is preferable to set the distance L to be 0.2 to 6 times the width of the induction coil, and more preferable to set the distance to be 0.6 to 4 times, considering the width of metal plate, the width of the induction coil and a traveling speed of the metal plate. If the distance becomes less than 0.2 times the width of the induction coil, cancellation of the induced currents in the upper and lower portions of the metal plate is experienced, which fails to heat effectively. If the distance becomes more than 6 times the width of induction coil, it becomes difficult to reduce a current density at the edge area of metal plate and heating time increases, which leads to a temperature increase at the edge area. In addition, the reactance also becomes large, which requires a high voltage power supply, which is difficult to carry out on an industrial scale. Hereinafter, when a width of the upper induction coil and a width of the lower induction coil are different, a width (in the longitudinal direction of the metal plate), unless otherwise defined, represents the width of wider induction coil.

When an appropriate distance is set in the central area in the transverse direction of the metal plate, the central area of the metal plate can be effectively heated. However, if the same distance is set at the edge area of the metal plate, the edge area of the metal plate is overheated as previously mentioned, forming a non-uniform temperature distribution in the transverse direction of the metal plate.

In the example shown in FIG. 6, the distance at the edge area of the metal plate is smaller than the distance at the central area, so that overheating at the edge area can be effectively restrained. Overheating at the edge area is restrained because by the smaller distance cancellation of the induced currents in upper and lower portions of the metal plate becomes prominent, which leads to reduced heating at the edge area. In addition, the heating time is simply shortened, which also leads to reduced heat divergence, since the heat divergence by the induction heating apparatus is proportional to the square of the current density and to the heating time.

In FIG. 6, an upper induction coil and a lower induction coil have specific bent portions where the induction coils stretch obliquely across the metal plate relative to the transverse direction. This obliqueness is also one of the reasons why overheating of the metal plate at the edge area is avoided.

Figure 8:
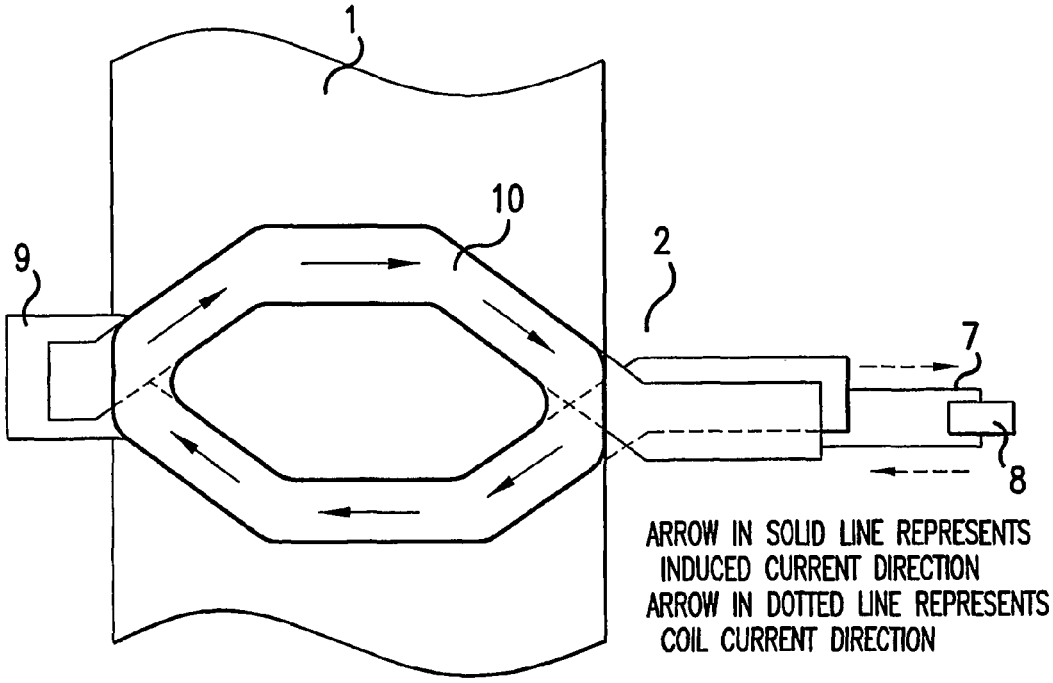
FIG. 8 is a schematic diagram illustrating the state of the induced current flow in the metal plate in FIG. 6 viewed from above the metal plate.

FIG. 8 is a schematic diagram illustrating the state of the induced current flow in the metal plate of FIG. 6 viewed from above the metal plate. An induced current 10 on the upper and lower sides of the metal plate flows in the opposite direction to a primary current passing through the induction coil where a width of the induced current is almost the same as a width of a projected image of the induction coil.

The induced current passing near the edge of the metal plate tends to follow a flow path closer to the central area of the metal plate so that the inductance between the induced current and the primary current running through the induction coil located at the edge of the metal plate can be reduced. In other words, an upper induced current induced by the upper induction coil and a lower induced current induced by the lower induction coil tend to connect to each other along the shortest path. This provides a relatively wider passage of induced current flow near the edge of the metal plate to restrain the increase of current density near the edge. Thus, when the upper and the lower induction coils have a portion that extends oblique to the transverse direction at edge area, overheating at the edge area can be effectively restrained relative to an induction coil without such an oblique portion.

While keeping the distance between the upper and lower induction coils provides the central area of the metal plate with an efficient heating, a relatively smaller distance and oblique arrangement of the induction coil at the edge area of the metal plate restrains overheating at the edge area. As a result, in the example of FIG. 6, uniform heating with in the transverse direction occurs.

An optimum distance between the upper and lower induction coils at different positions in the transverse direction should be determined after taking into consideration a preexisting temperature distribution of the metal plate to be heated. It is possible to have three different representative preexisting temperature distribution patterns in a metal plate, for example, a metal plate that has a flat temperature distribution (the same temperature at the central area and the edge area), a metal plate, that has a temperature distribution that is slightly lower at the edge area relative to the central area, or a metal plate that has a temperature distribution that is slightly higher at the edge area relative to the temperature in the central area.

Figure 9:
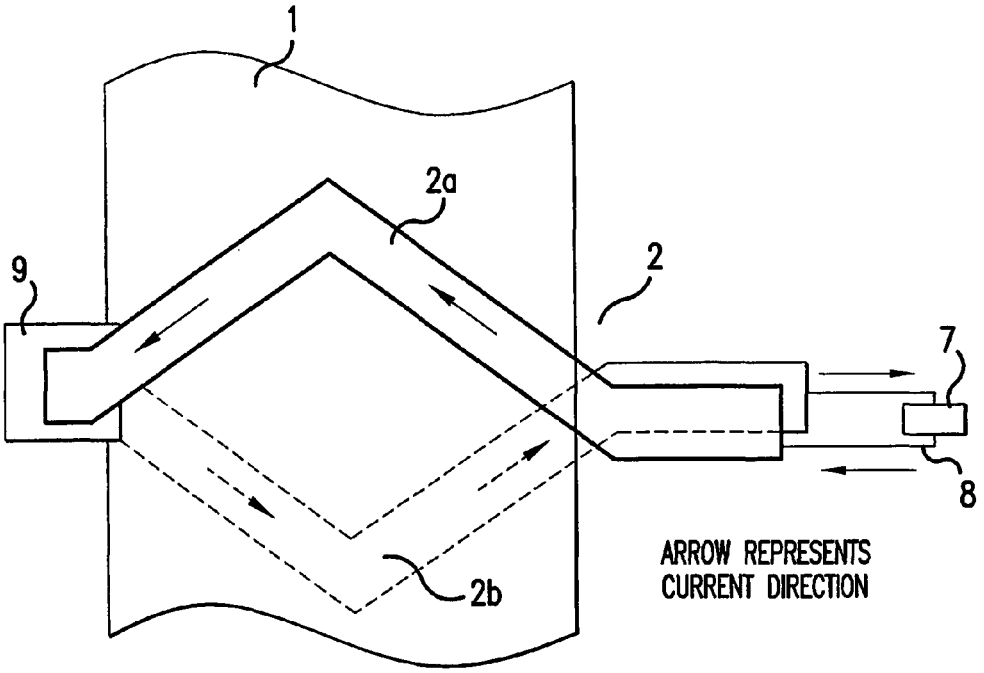
FIG. 9 is a schematic diagram of an embodiment of the present invention.
Figure 10:
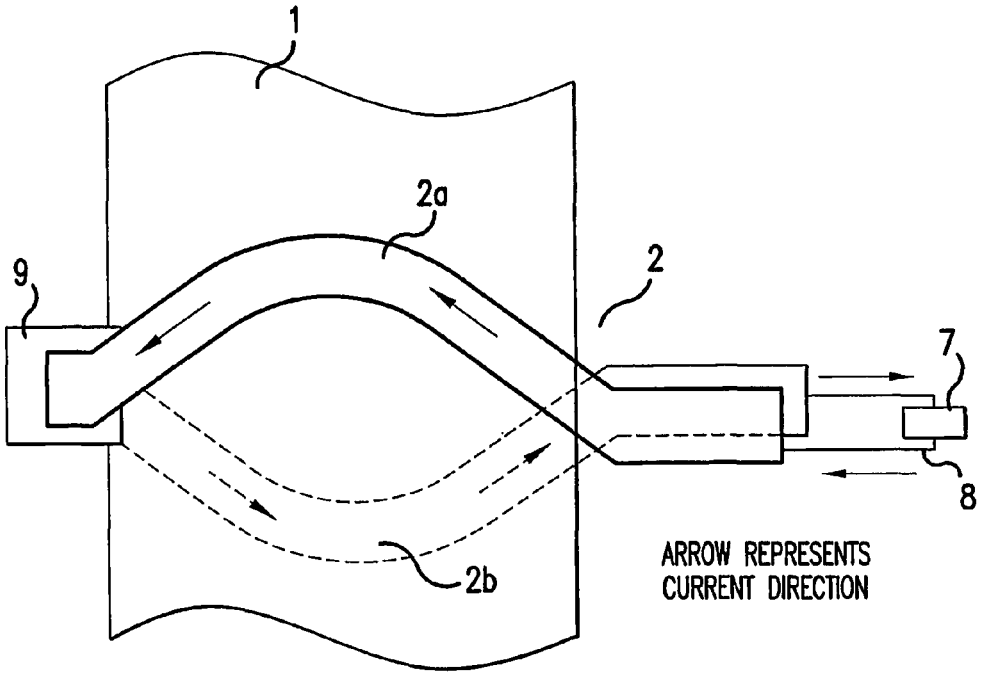
FIG. 10 is a schematic diagram of an embodiment of the present invention.
Figure 11:
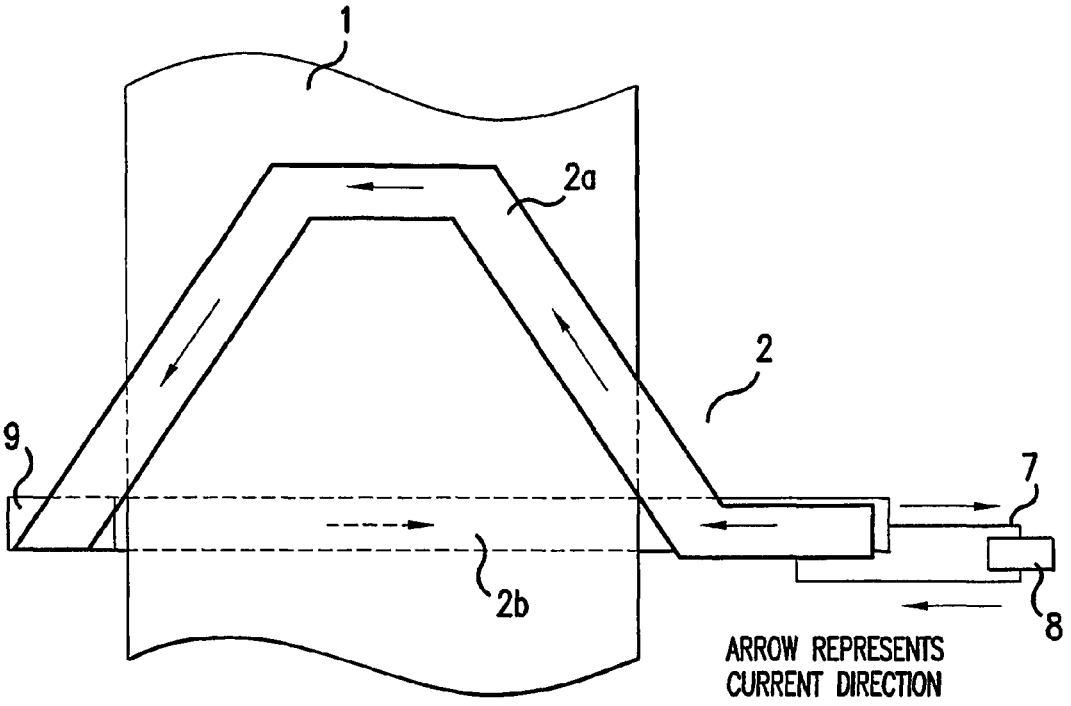
FIG. 11 is a schematic diagram of an embodiment of the present invention.
Figure 12:
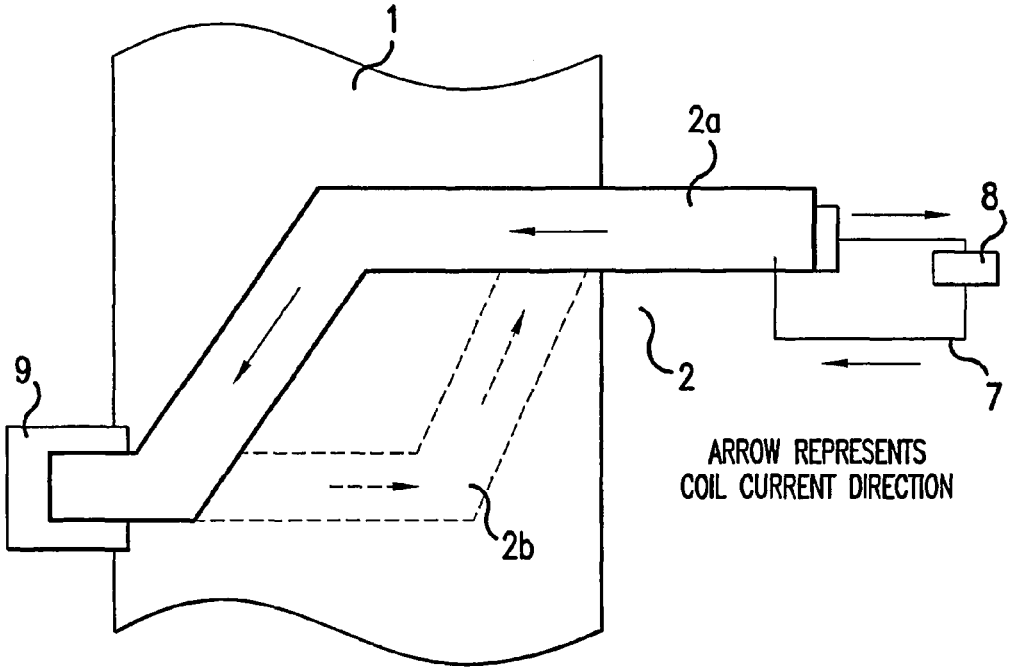
FIG. 12 is a schematic diagram of an embodiment of the present invention.

In the present invention, an upper part of the induction coil located above the metal plate and a lower part of the induction coil located below the metal plate are arranged so as to be located respectively in different positions in the longitudinal direction of the metal plate at least at one position in the transverse direction of the metal plate, wherein a distance between the different positions varies in the transverse direction. The shape of the induction coil is not limited to the one shown in FIG. 6. For example, the shape shown in FIG. 9 where a pair of dogleg shaped upper and lower parts of the induction coil are placed in reverse direction or the shape shown in FIG. 10 where a pair of arc shaped upper and lower parts of the induction coil are placed in reverse direction can be used for the shape of the induction coil. Various other shapes can also be used as the shape of the induction coil. For example, the shape shown in FIG. 11 can be used, where only an upper induction coil is hat-shaped and the lower induction coil is straight. In addition, the shape shown in FIG. 12 can be used, where a pair of dogleg shapes is placed in a reverse direction, but the shapes are not symmetrical about a longitudinal center line of the metal plate. In FIG. 12, reference numeral 2*a* represents an upper induction coil located above a metal plate 1, reference numeral 2*b* represents a lower induction coil located below the metal plate 1, and reference numerals 7, 8 and 9 represent a conductive member, an AC power supply and an induction coil located near the edge of metal plate, respectively.

Figure 13:
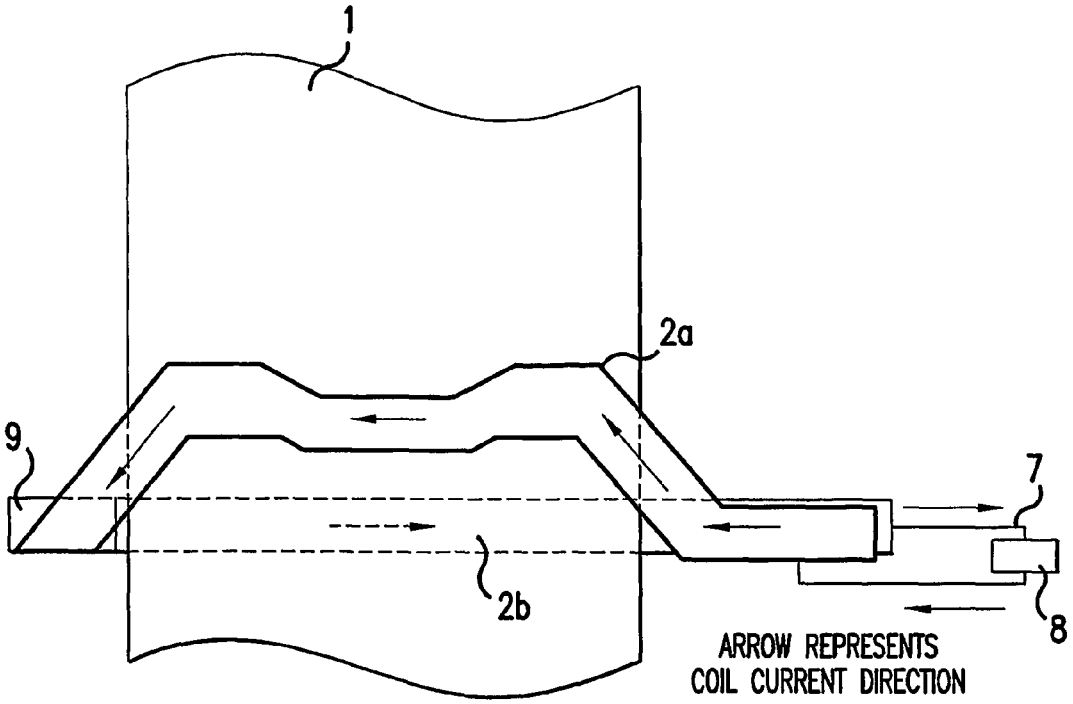
FIG. 13 is a schematic diagram of an embodiment of the present invention.

In the example shown in FIG. 13, the distance is smaller in the central area and the upper induction coil has a narrowed width in the central area and an oblique portion at the edge area. Reference numerals 7, 8 and 9 represent a conductive member, an AC power supply and an induction coil located near the edge of metal plate, respectively. It is known that the heat divergence by an induction heating apparatus is proportional to the square of the current density and to the heating time. In the example of FIG. 13, the current density in the central area is higher than the current density in the edge area, since the induction coil is narrowed in width in the central area, which leads to an increase of the heat divergence in the central area relative to the heat divergence in the edge area.

When the metal plate to be fed in an induction heating apparatus has a preexisting temperature distribution, where the edge area temperature is slightly higher than that of the central area (central area temperature is slightly lower than that of the edge area), the apparatus of FIG. 13 can be preferably used to obtain a metal plate with a more uniform temperature distribution after heating.

Figure 14:
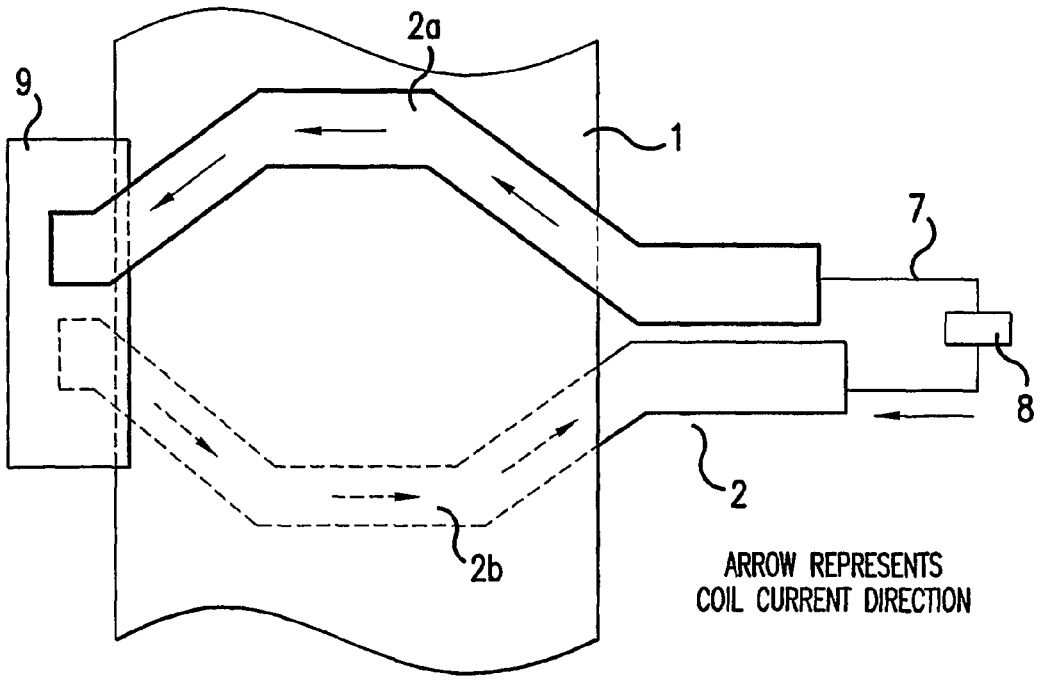
FIG. 14 is a schematic diagram of an embodiment of the present invention.

In the example shown in FIG. 14, as in the example of FIG. 6, an upper induction coil 2*a* and a lower induction coil 2*b* are arranged obliquely at the edge area so that the amount of distance therebetween becomes smaller toward the edge of the metal plate.

Reference numerals 7, 8 and 9 represent a conductive member, an AC power supply and an induction coil located near the edge of metal plate, respectively. In the example of FIG. 14; however, the distance between the upper induction coil and the lower induction coil is larger than that of FIG. 6. Therefore, in the apparatus of FIG. 14, the temperature increase at the edge area can be expected greater than the temperature increase that occurs in the FIG. 6 apparatus. Thus, the FIG. 14 example is suitable for heating a metal plate that has an edge area temperature that is lower relative to that of the central area.

Figure 15:
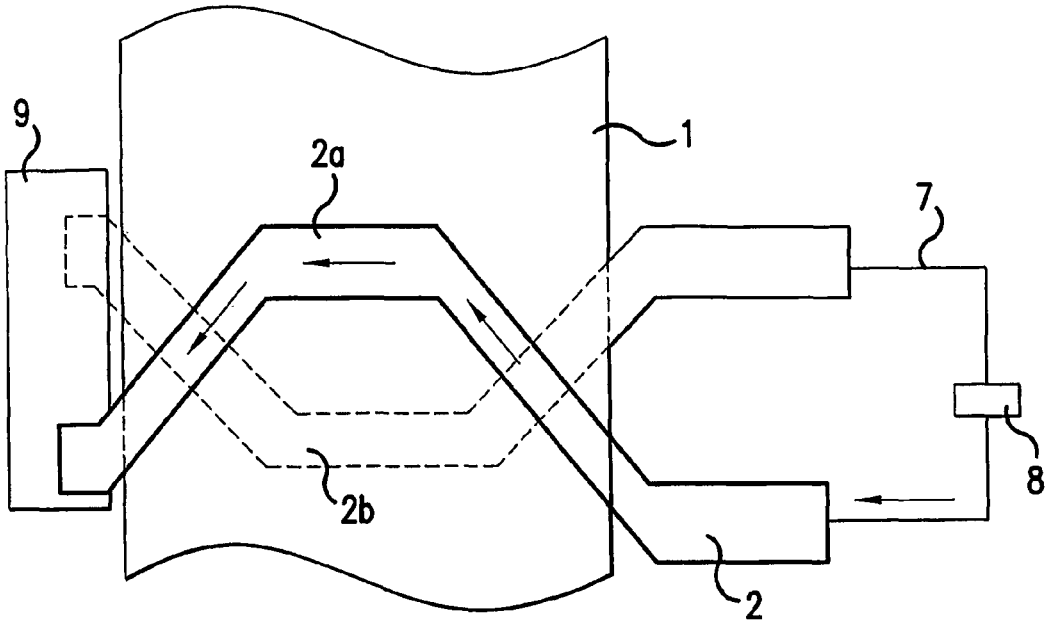
FIG. 15 is a schematic diagram of an embodiment of the present invention.

FIG. 15 shows an apparatus where an upper induction coil and a lower induction coil intersect in the edge area in terms of the projected images of both coils. In this example, it is expected to have a larger heat divergence in the central area and a smaller heat divergence in the edge area. This orientation is suitable for heating a metal plate that has a central area temperature that is lower relative to that of the edge area.

Figure 16:
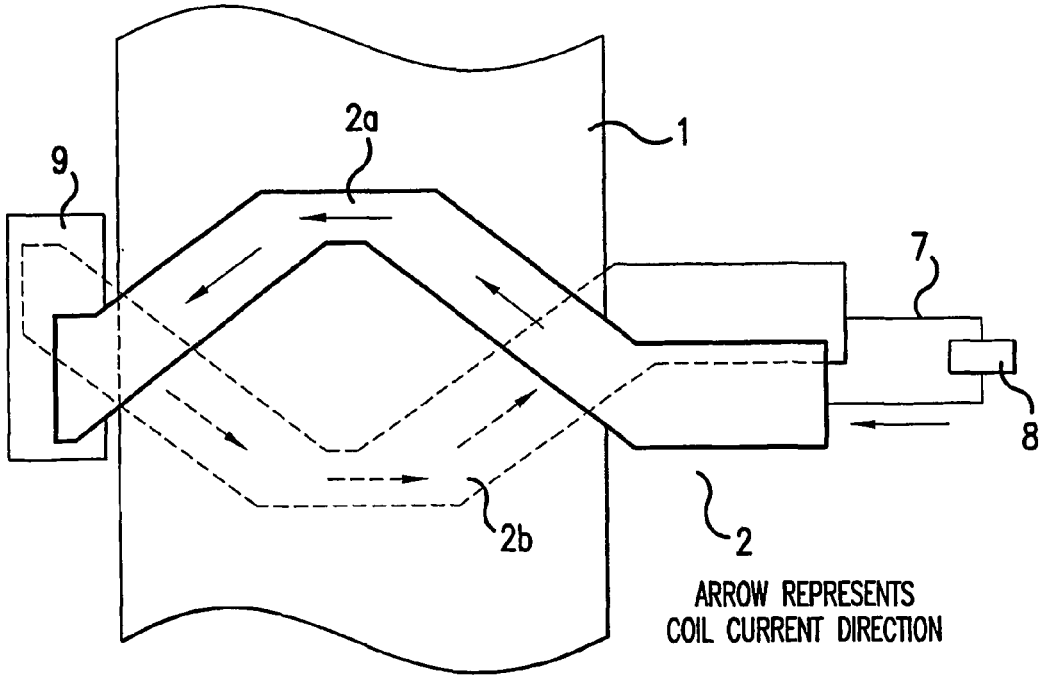
FIG. 16 is a schematic diagram of an embodiment of the present invention.

FIG. 16 shows an apparatus where an upper induction coil 2*a* and a lower induction coil 2*b* have a bent portion respectively in the edge area where each of the induction coils stretches obliquely across the metal plate relative to the transverse direction and the width of the induction coil is wider than that in the central area. Reference numerals 7, 8 and 9 represent a conductive member, an AC power supply and an induction coil located near the edge of metal plate, respectively. In this example, the current density in the central area of the metal plate is higher than in FIG. 6. Therefore, the heat divergence in the central area can be larger than in FIG. 6, since the heat divergence is proportional to the square of the current density and the heating time.

Figure 17:
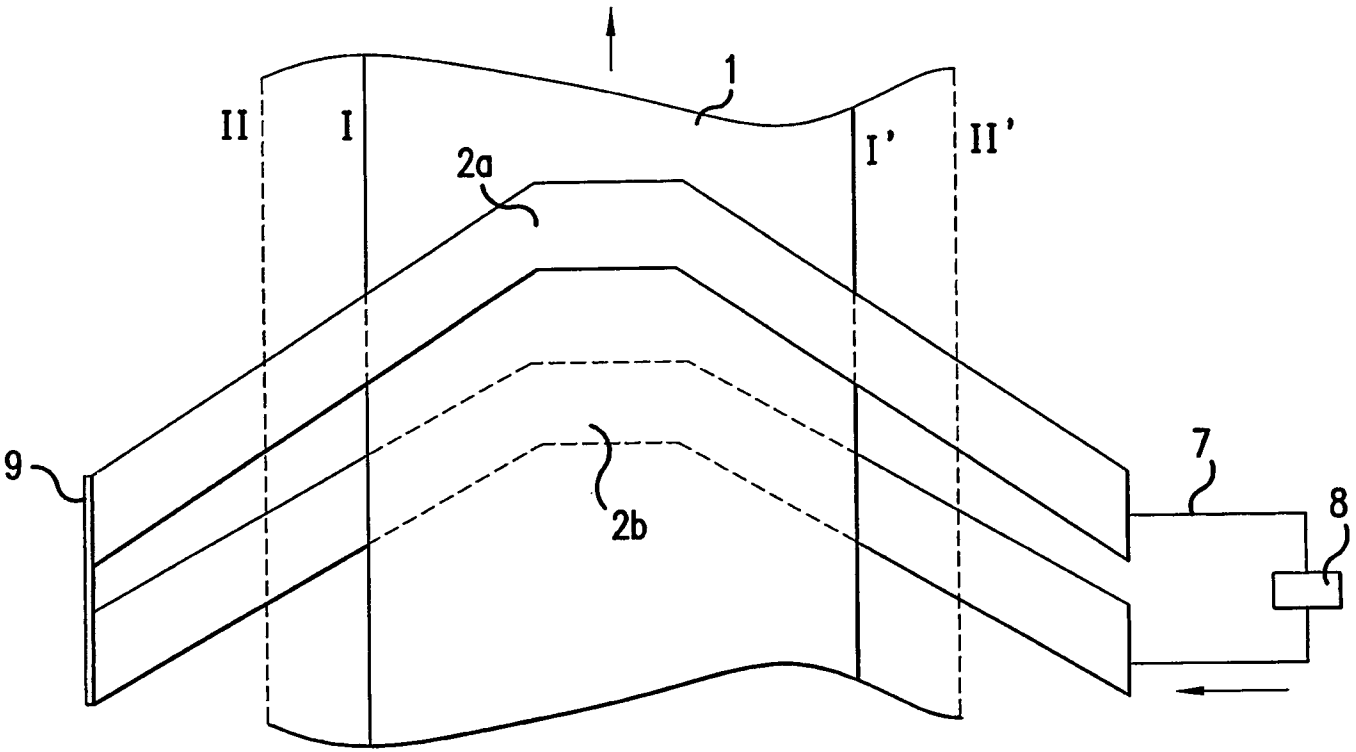
FIG. 17 is a schematic diagram of an embodiment of the present invention.

FIG. 17 shows an apparatus where an upper induction coil 2*a* and a lower induction coil 2*b* have a bent portion respectively in the edge area where each of the induction coils stretches obliquely across the metal plate relative to the transverse direction and the oblique angles of the upper induction coil and the lower induction coil are different so that the distance between the two induction coils can gradually decrease from the central area toward the edge area and the edge.

In FIG. 17, the wider the metal plate becomes, the less the heat divergence in the edge area becomes. This example is suitable when the width of the metal plate increases, such as from the width I-I' to II-II' in FIG. 17, or the temperature difference in the metal (the temperature in the edge area of the metal plate)−(the temperature in the central area of the metal plate)} becomes larger.

Figure 18:
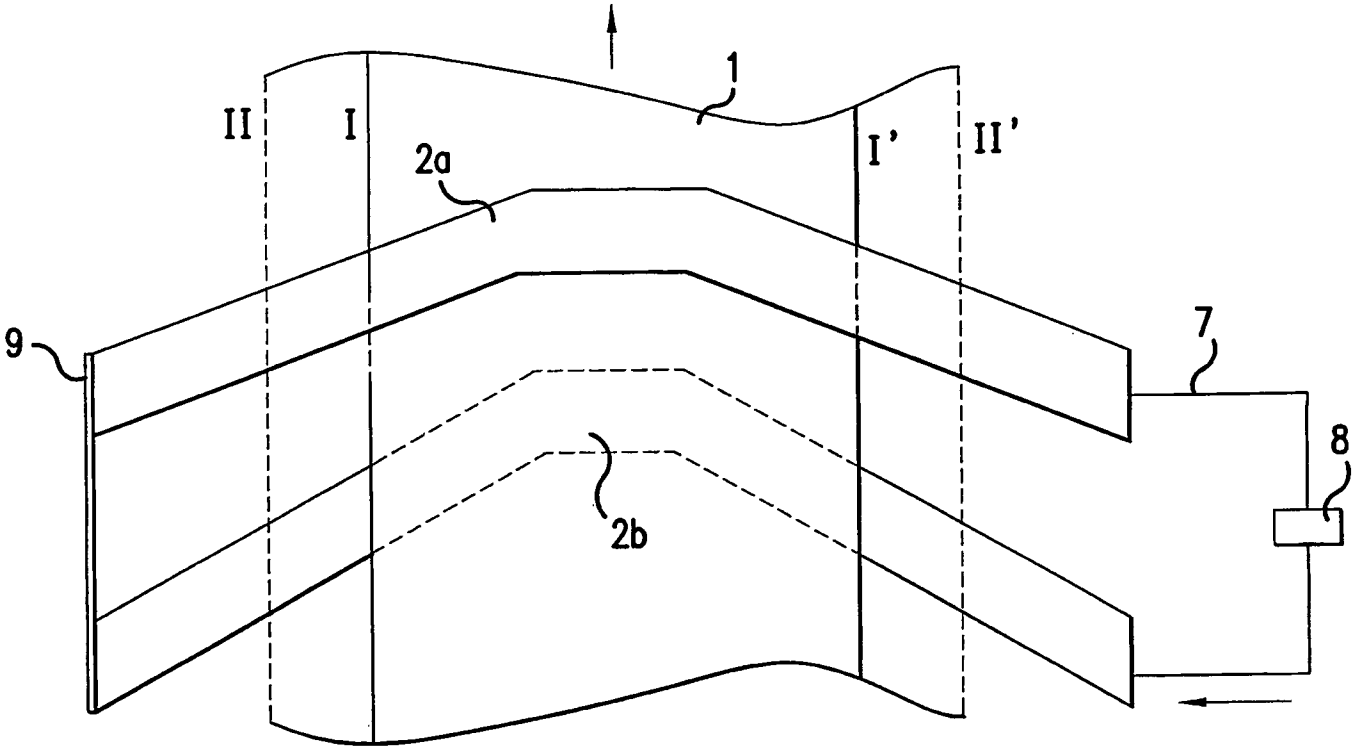
FIG. 18 is a schematic diagram of an embodiment of the present invention.

FIG. 18 shows an apparatus where an upper induction coil 2*a* and a lower induction coil 2*b* have a bent portion respectively in the edge area where each of the induction coils stretches obliquely across the metal plate relative to the transverse direction and the oblique angles of the upper induction coil and the lower induction coil are different, so that the distance between the two induction coils can gradually increase from the central area toward the edge area and the edge. In FIG. 18, the wider the metal plate becomes, the more the heat divergence in the edge area becomes. This example is suitable for when the width of metal plate becomes wider such as from the width of I-I' to II-II' in FIG. 18, or the temperature in the edge area of the metal plate becomes lower relative to that in the central area. A more uniform temperature distribution can be expected after heating with this apparatus.

In order to obtain a necessary heat divergence in a practical operation of the heating apparatus of the present invention, it is possible to determine the distance and/or the width of the induction coil for each position in the transverse direction in advance through an electromagnetic field analysis. However, because of a fluctuation in a previous process, a metal plate to be fed into the induction heating apparatus of the present invention may have an initial temperature variation. Therefore, the necessary heat divergence may not be obtained even if the predetermined distance and/or the width of the induction coil are adopted.

If the distance between upper and lower coils increases, it helps to avoid Cancellation of induced currents in the metal plate and an increase in the heating time, which leads to an increase in the heat divergence. In another embodiment of the present invention, where the distance is adjustable, it is possible to obtain a desired temperature independently of the preexisting temperature state given by the previous process by adjusting the distance to the temperature variation of the metal to be fed in.

Figure 19:
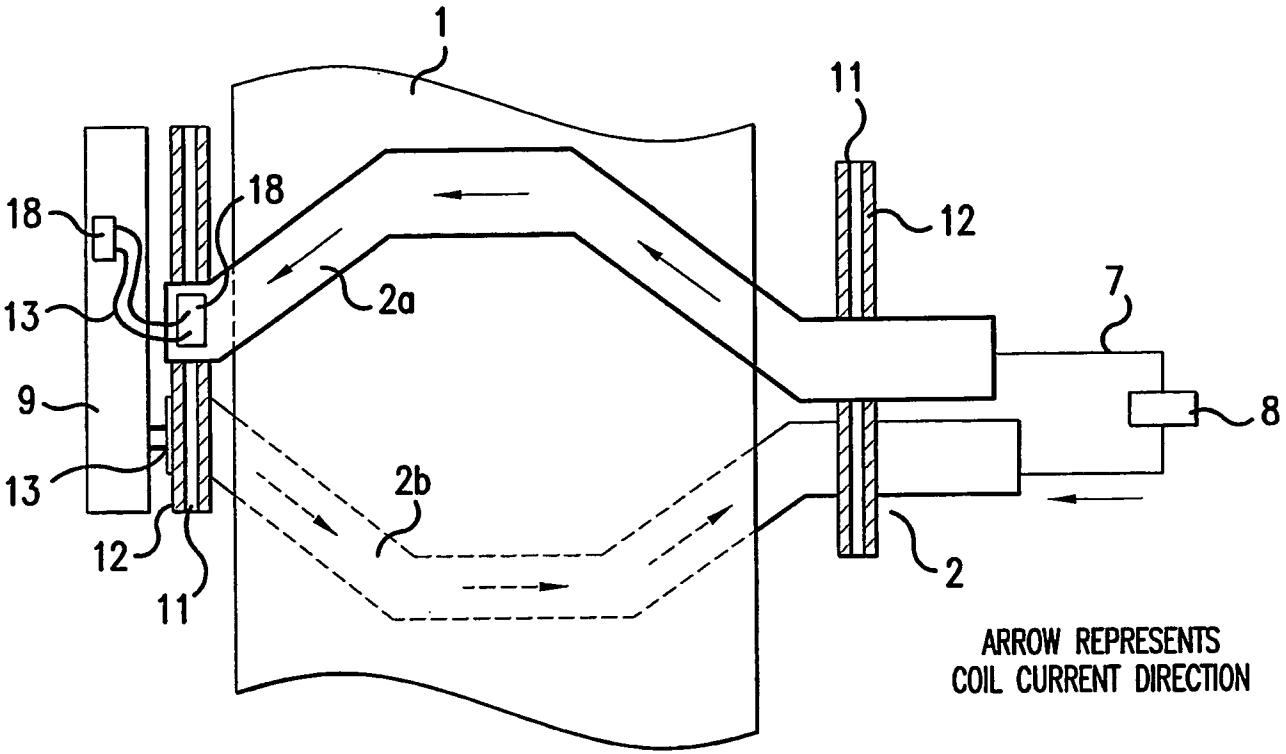
FIG. 19 is a schematic diagram of an embodiment of the present invention.
Figure 20:
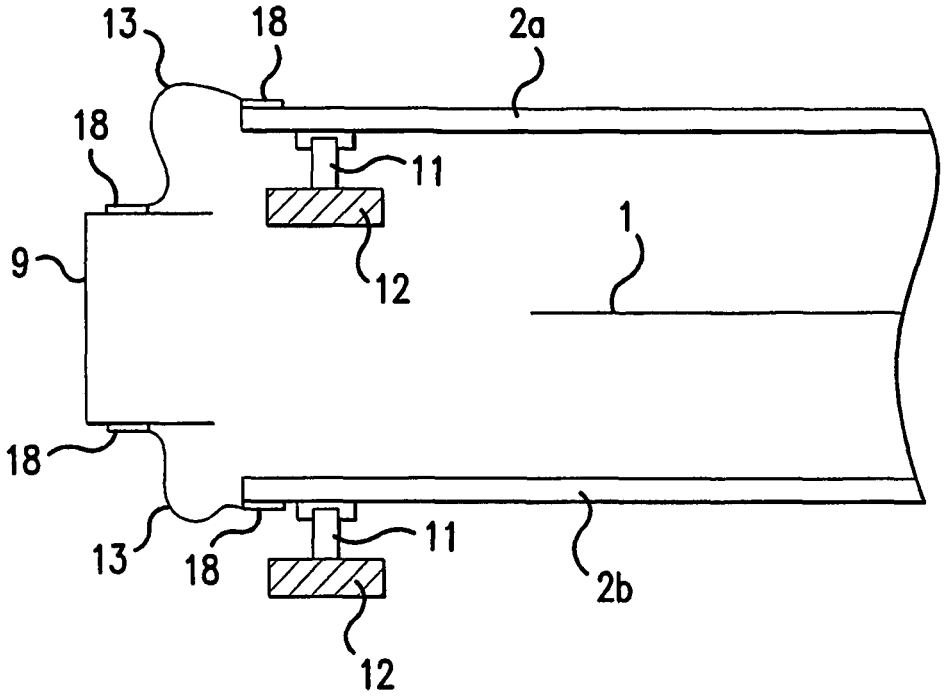
FIG. 20 is a schematic cross-sectional view of FIG. 19.

FIG. 19 shows an upper induction coil 2*a* and a lower induction coil 2*b* each of which is slidably mounted on a pair of guide rails 11 fixed on a pair of bases 12 that extend in the longitudinal direction of the metal plate 1. FIG. 20 is a cross sectional view of FIG. 19. The induction coil can be moved by well known means (not shown in FIG. 19), such as an air cylinder, a hydraulic cylinder of a motor-driven cylinder. Although FIG. 19 shows that both upper and lower induction coils are movably mounted, it is also acceptable that only on of the upper and lower coils is movable. The base 12 and/or the rail 11 can be made from insulation materials such as ceramics and/or resins, since they are placed in a strong magnetic field in the vicinity of the induction coil. When a metal is used in some applications, it is required that non-magnetic metal such as stainless steel, brass or aluminum be used. The base and the rail should be located as far as possible from the induction coil. In addition, the base and the rail should be water-cooled to prevent heating from the induced current. The upper and lower induction coils 2*a*, 2*b* are connected to a water-cooled connector 9 via movable conductive member 13 such as a water-cooled cable. Reference numeral 18 represents a connecting terminal of a copper plate.

As with some other examples, the upper induction coil 2*a* and the lower induction coil 2*b* in FIG. 19 are parallel to the transverse direction in the central area and have a bent portion respectively in the edge area where each of the induction coils stretches obliquely across the metal plate relative to the transverse direction. Thus, the distance can vary at different positions in the transverse direction.

The heat divergence is controlled by changing the amount of distance between the upper and lower induction coils as set forth above. Therefore, for example, the amount of distance can be changed according to the temperature of the metal plate measured by a thermometer located upstream of the induction heating apparatus.

In order to obtain a heat divergence needed at each position in the transverse direction, it is possible to determine the distance and/or the width of the induction coil for each position in the transverse direction in advance through electromagnetic field analysis. However, when a width of the metal plate is changed in accordance with a manufacturing lot-change, a metal plate with a uniform temperature distribution may not be obtained, even if the above predetermined amount of the distance for each position in the transverse direction of induction coil are adopted.

Figure 21:
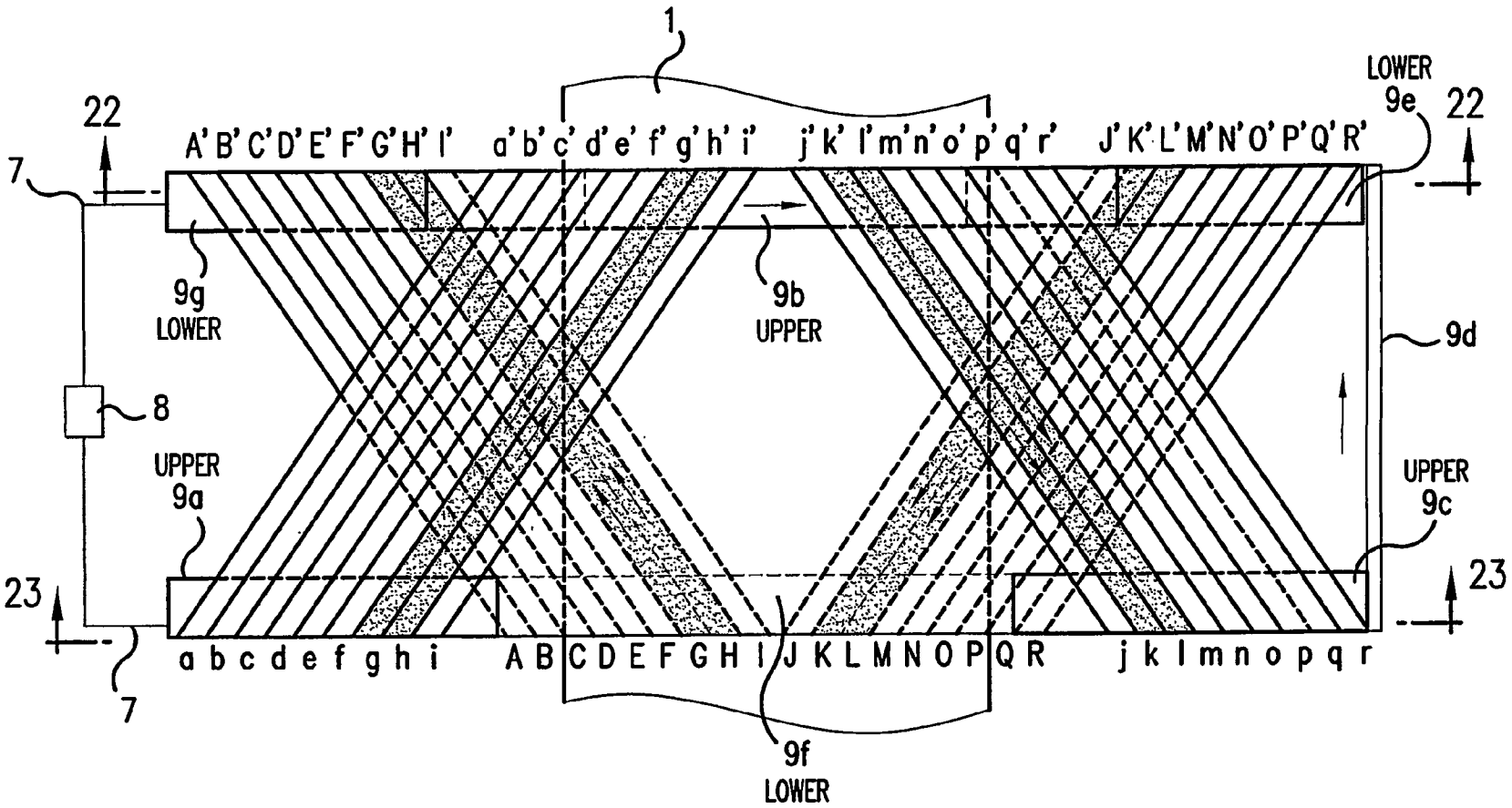
FIG. 21 is a schematic diagram of an embodiment of the present invention.

FIG. 21 shows another embodiment for making the distance changeable for each position in the transverse direction, which makes it possible to obtain a uniform temperature distribution, even when the width of the metal plate to be fed is changed.

In FIG. 21, an upper induction coil includes a plurality of edge area conductors a-a' to i-i' and j-j' to r-r' each of which is insulated and independent from each other. Each of the edge area conductors a-a' to i-i' and j-j' to r-r' is selectably connected to a central area connecting conductor 9*b*. The selectable connection can be performed using a well-known contact controller (not shown in FIG. 21) such as an electromagnetic contactor, an air cylinder or a motor-driven cylinder.

A lower induction coil includes a plurality of edge area conductors A-A' to I-I' and J-J' to R-R' each of which is insulated and independent from each other. Each of the edge area conductors A-A' to I-I' and J-J' to R-R' is selectably connected to a central area connecting conductor 9*f*.

As with other examples, in the embodiment of FIG. 21, there is a distance between the upper induction coil and the lower induction coil in the longitudinal direction of the metal plate in terms of the projected images of both coils. The distance between the upper and lower induction coils can vary at different positions in the traverse direction. The upper and lower induction coils are designed so that the distance in the central area of the metal plate can be larger than the distance in the edge area of the metal plate. Both coils have a bent portion respectively in the edge area where each of the induction coils stretches obliquely across the metal plate relative to the transverse direction.

Figure 22:
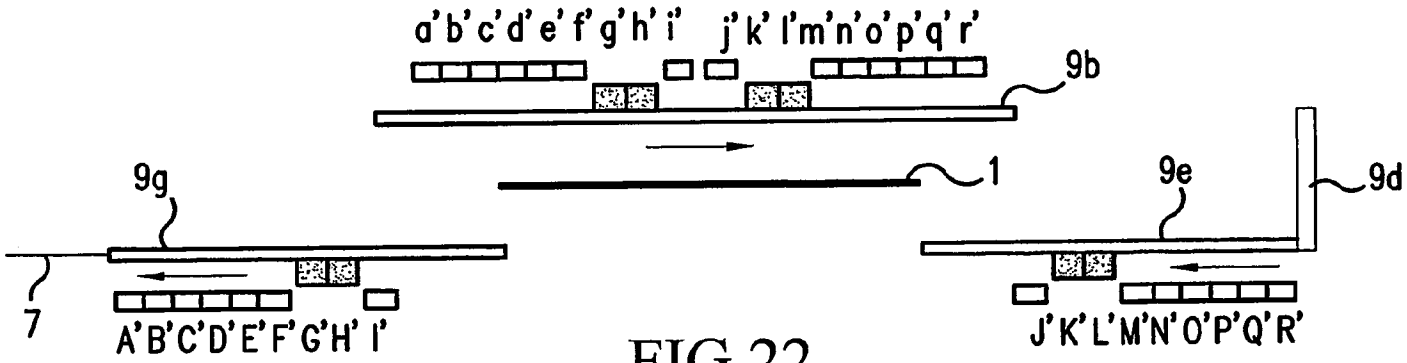
FIG. 22 is a schematic diagram of a cross-sectional view taken on line 22-22 of FIG. 21.
Figure 23:
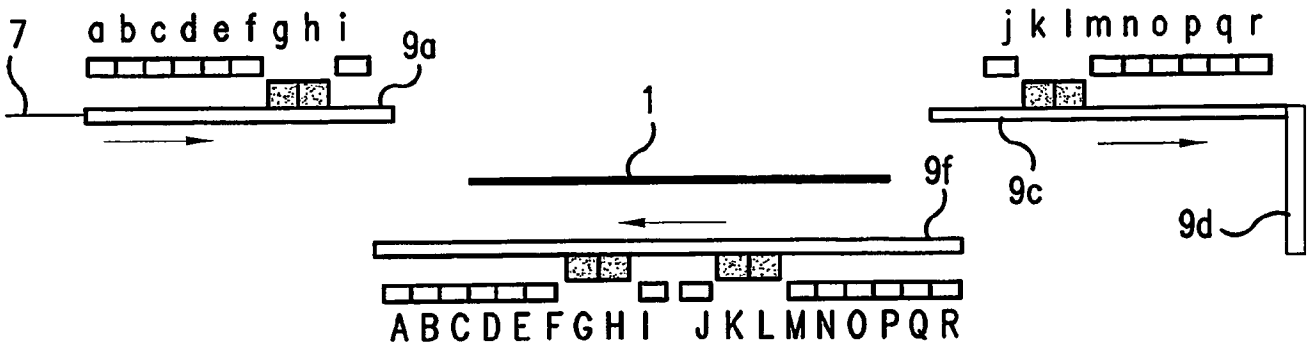
FIG. 23 is a schematic diagram of a cross-sectional view taken on line 23-23 of FIG. 21.

FIG. 22 is a cross sectional view taken on line 22-22 of FIG. 21. FIG. 23 is a cross sectional view taken on line 23-23 of FIG. 21.

In the embodiment shown in FIG. 21, current which departs from a conductive member 7 connected to an AC power supply 8 runs through a closed loop of the induction coils as shown below. Current from the conductor 7 runs through, in turn, the connecting conductors 9*a*, the conductors g-g' and h-h', the central area connecting conductor 9*b*, the conductors k-k' and I-I', the connecting conductor 9*c*, the connecting conductor 9*d*, the connecting conductor 9*e*, (enters into the lower induction coil region), through the conductors K-K' and L-L', the central connecting conductor 9*f*, the conductors G-G' and H-H', the connecting conductor 9g, the conductive member 7 and then back to the AC power supply. Conductors and connecting conductors should be made of excellent conductive material such as copper.

Figure 24:
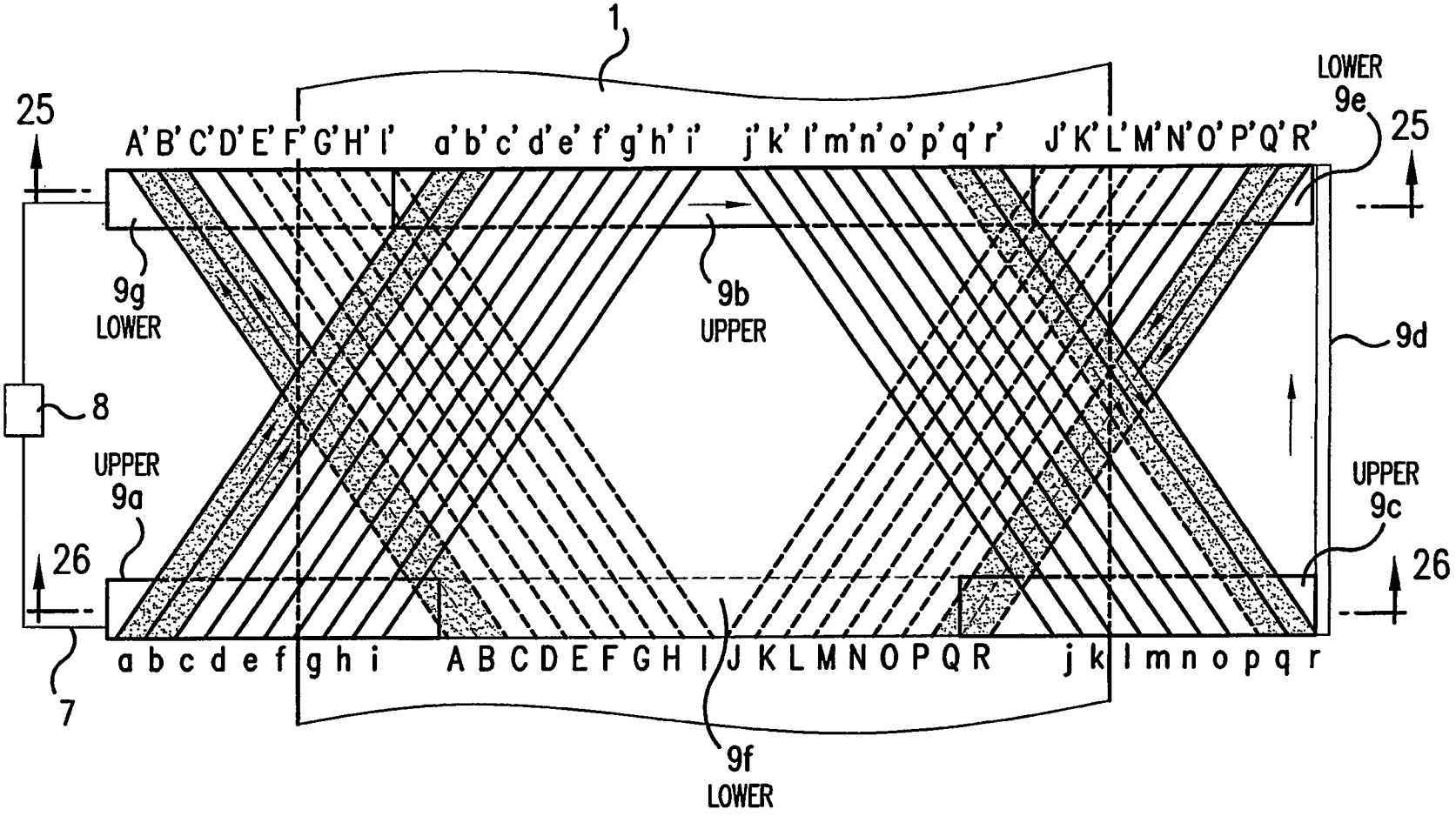
FIG. 24 is a schematic diagram of an embodiment of the present invention.

FIG. 24 is a plan view of an induction heating apparatus where a wider metal plate is handled.

Figure 25:
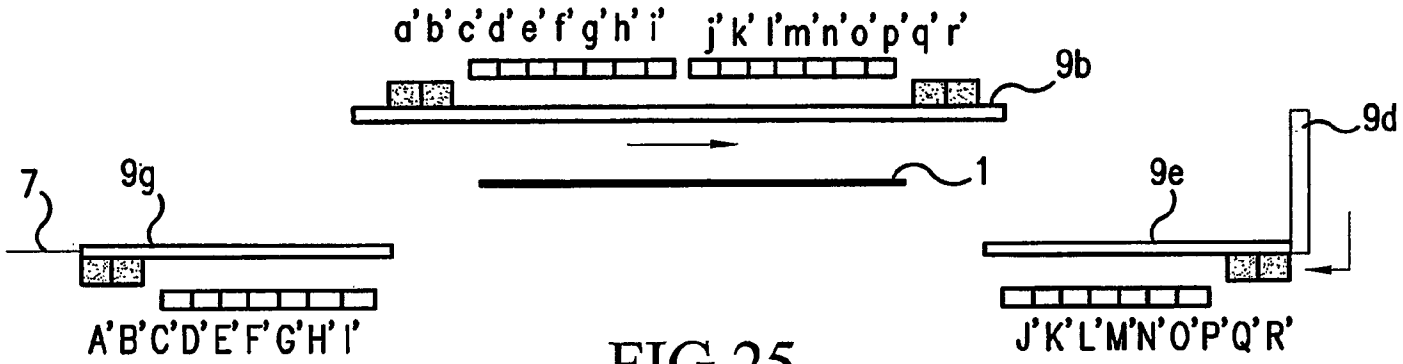
FIG. 25 is a schematic diagram of a cross-sectional view taken on line 25-25 of FIG. 24.

FIG. 25 is a cross-sectional view taken on line 25-25 of FIG. 24.

Figure 26:
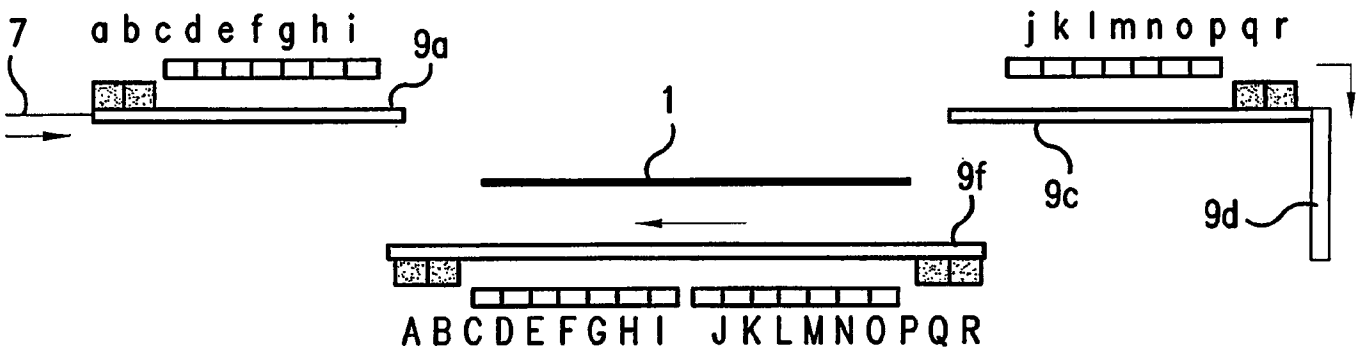
FIG. 26 is a schematic diagram of a cross-sectional view taken on line 26-26 of FIG. 24.

FIG. 26 is a cross-sectional view taken on line 26-26 of FIG. 24.

In comparison with the case shown in FIG. 21, energized conductors are changed from g-g' and h-h' to a-a' and b-b', from k-k' and l-l' to q-q' and r-r' (with the upper induction coil); from K-K' and L-L' to Q-Q' and R-R', and from G-G' and H-H' to A-A' and B-B' (with lower induction coil). A selectable connection for changing the conductor to be energized can be performed using a well-known contact controller such as an electromagnetic contactor, an air cylinder or a motor-driven cylinder.

Thus, even when the width of the metal plate to be heated changes from a narrower one to a wider one (from the case shown in FIG. 21 to the case shown in FIG. 24), the distance can still be kept the same as before both in the central area and the edge area by selecting a proper conductor to be energized according to the width of new metal plate. This makes it possible to eliminate problems caused by the width change with respect to the temperature and the temperature distribution of the metal plate after heating.

The induction heating apparatus of the present invention can be used stand-alone, as a process set before/after preheating a furnace of an indirect heating type or as a process combined in series with a conventional LF (Longitudinal Flux) type heating apparatus so as to prevent interference between the induction coils. The induction heating apparatus of the present invention can be used with high efficiency for heating a metal plate even in the region of a large induced current penetration depth at a temperature above the Curie point, since the upper induction coil and the lower induction coil are located at a distance from each other in the longitudinal direction of the metal plate (there is a distance between the upper and lower induction coils in terms of the projected images of both coils). In view of above, the induction heating apparatus of the present invention can be used more preferably for a metal plate that has a temperature above the Curie point while a low cost indirect heating furnace can be used for a metal plate that has a temperature sufficiently lower than the Curie point.

Embodiment 1

A heating test of the present invention was carried out with a metal plate made of non-magnetic SUS304 steel plate (thickness: 0.2 mm, width: 600 mm). The test will be described with reference to FIGS. 27A and 27B. The AC power supply (not shown) was 25 KHz, and a capacitor having a 100 KW capacitance was adjusted to match the induction coil to be used. The induction coil used was a single turn (surrounding the steel plate to be heated) induction coil. A water-cooled copper plate was constructed of a copper plate having a thickness of 5 mm and a width of 100 mm (different from a width defined for the present invention). A water-cooling copper tube (outer diameter: 10 mm, inner diameter: 8 mm) was attached to the copper plate on the side (outer side) opposite to the steel plate by brazing. In this example, the "induction coil" included both a copper plate and a water-cooling copper tube, since the electric current also runs through the copper tube. A gap between the steel plate to be heated and the induction coil was 50 mm. A distance between the upper induction coil located above the steel plate and a lower induction coil located below the steel plate in the longitudinal direction of the steel plate was 200 mm in the central area of the steel plate in the transverse direction (i.e., a maximum distance was 200 mm).

The distance at the edge area of the steel plate is adjustable by changing an oblique angle of the induction coil in the edge area. More specifically, as shown in FIGS. 27A-FIG. 27D, the induction coil is constructed of a left side portion, a right side portion and a connecting copper plate in the middle to connect the left and right portions. The induction coil is angle-adjustably fixed to a synthetic resin board (a bakelite board) of the induction coil supporting base via the connecting copper plate. Angle-adjusting holes are formed at predetermined positions in the water-cooled copper plate (the induction coil) for fixing the left and right portions together with the connecting copper plate.

Figure 27A:
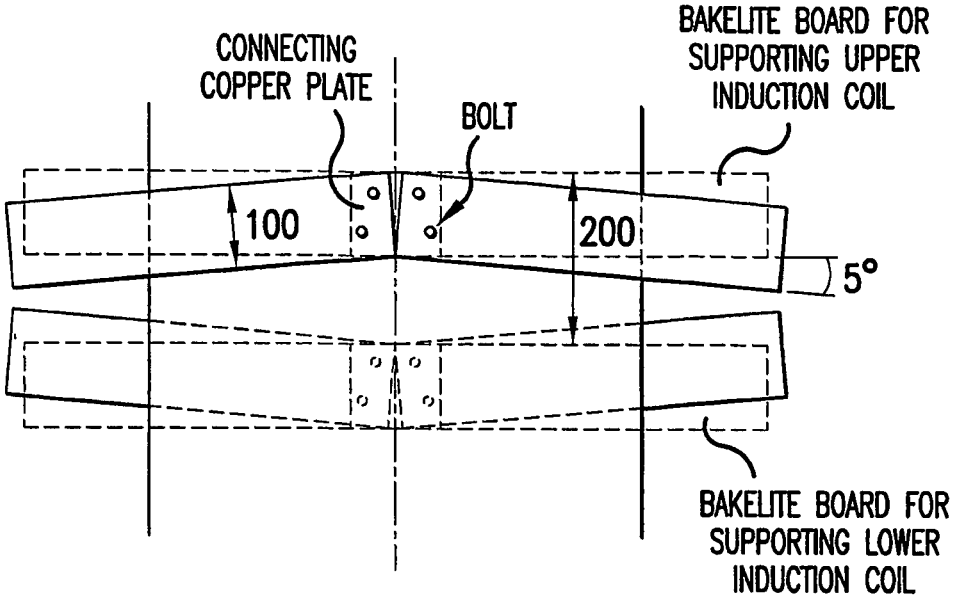
FIG. 27 is a schematic diagram of an embodiment of the present invention.
Figure 27B:
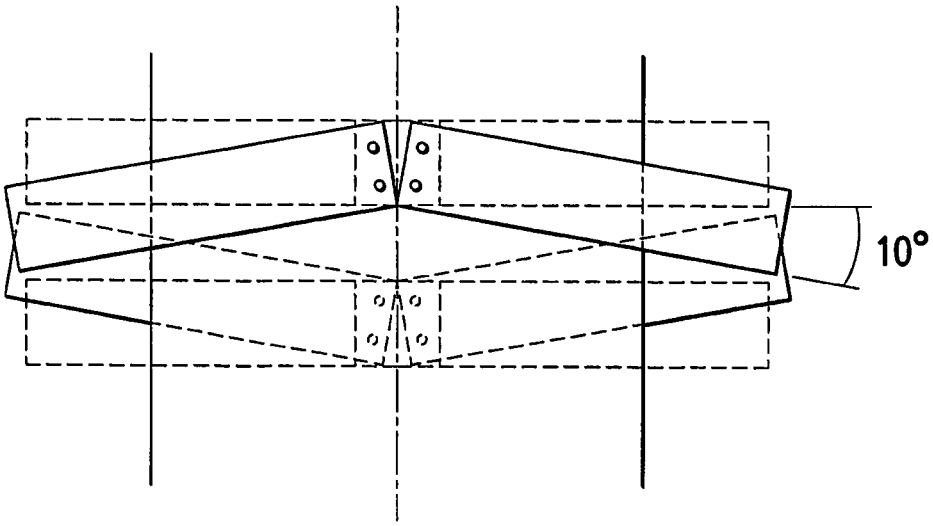
Figure 27C:
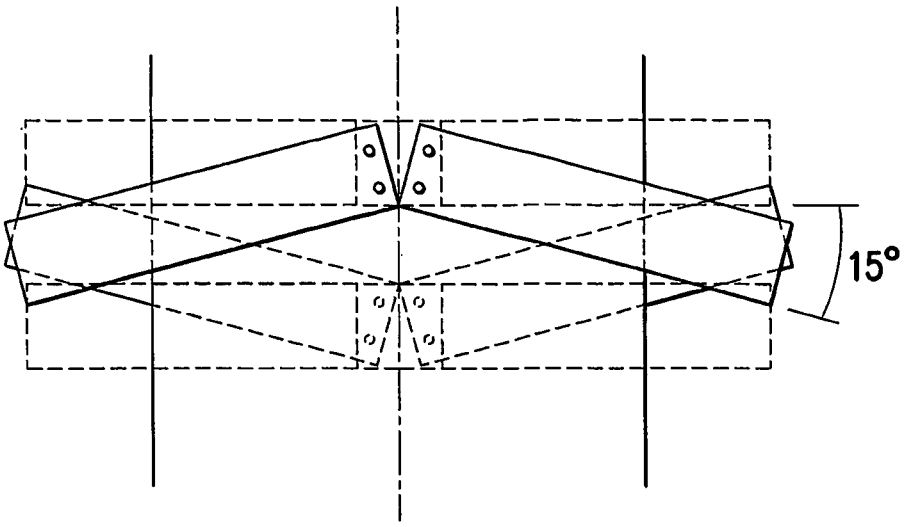
Figure 27D:
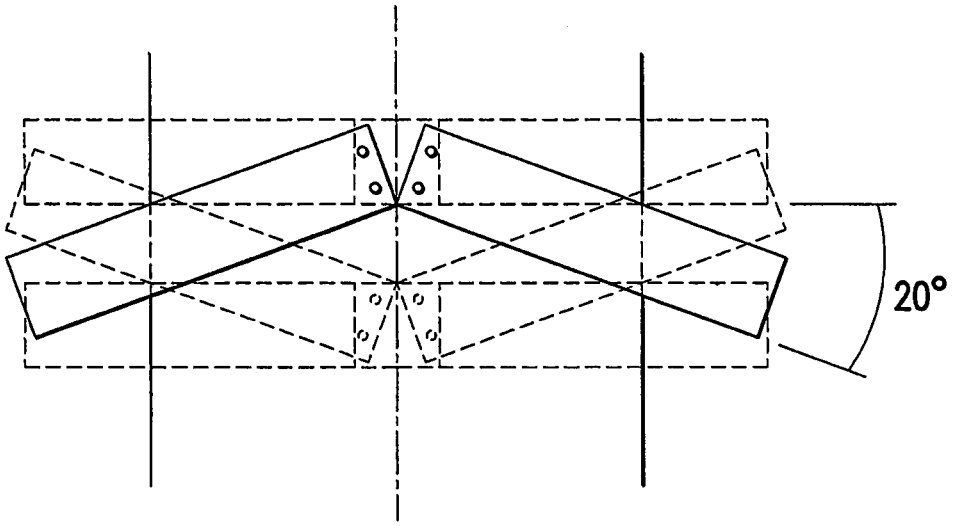

FIG. 27A shows example A of the present invention where both induction coils are set with a 5 degree angle to an edge line of the bakelite board (the angle between the induction coil and the transverse direction of the steel plate to be heated (oblique angle) is 5 degrees). FIG. 27B shows example B of the present invention where both induction coils are set with a 10 degree angle to the edge line of the bakelite board (the angle between the induction coil and the transverse direction of the steel plate to be heated (oblique angle) is 10 degrees). FIG. 27C shows example C of the present invention where both induction coils are set with a 15 degree angle to the edge line of the bakelite board (the angle between the induction coil and the transverse direction of the steel plate to be heated (oblique angle) is 15 degrees). FIG. 27D shows example D of the invention where both induction coils are set with a 20 degree angle to the edge line of the bakelite board (the angle between the induction coil and the transverse direction of the steel plate to be heated (oblique angle) is 20 degrees). In all of the cases above, the traveling speed of the steel plate is 2 m/min.

The steel plate is heated by the induction heating apparatus while the distance in the edge area as described above is changed, and the temperature of the steel plate at both the central area and the edge area (a position 50 mm away from edge of the steel plate) was measured at the exit of the induction heating apparatus using a two-dimensional infrared thermometer to calculate a value of {(the temperature at the edge area)−(the temperature at the central area)}. The results are shown in TABLE 1 below.

TABLE 1

| | angle between induction coil and steel plate transverse direction (oblique angle) | (temperature at the edge area) − (temperature at the central area) |
|---|---|---|
| FIG. 27A | 5 degrees | 220° C. |
| FIG. 27B | 10 degrees | 30° C. |
| FIG. 27C | 15 degrees | 2° C. |
| FIG. 27D | 20 degrees | −40° C. |

It can be found from the above results that the temperatures of the edge area and the central area can be changed (the temperature distribution can be changed) by changing the distance between the upper induction coil and the lower induction coil at the edge area. In FIG. 27C, where the angle between the induction coil and the steel plate transverse direction is 15 degrees, the temperatures in the central area and in the edge area are almost the same (a uniform temperature distribution).

In FIG. 27D, where the angle between the induction coil and the steel plate transverse direction is 20 degrees, heating in the edge area is lowered. Use of this condition is suitable for treating a metal plate having a preexisting temperature distribution provided by a previous process where the temperature in the edge area is higher than that in the central area.

Embodiment 2

A heating test of the present invention was also carried out with respect to a cold rolled steel plate (thickness: 0.6 mm, width: 600 mm). The AC power supply (not shown) was 50 KHz, and a capacitor having a 200 KW capacitance was adjusted to match the induction coil to be used. The traveling speed of the steel plate was 2 m/min.

The temperature of the steel plate at both the central area and the edge area (at a position 50 mm away from the edge of the steel plate) was measured at the exit of the induction coils using an infrared thermometer.

The results are shown in TABLE 2, where the combinations of the selected induction coil conductors and the resulting difference between the temperatures at the edge area and the central area, i.e., (the temperature at the edge area)-(the temperature at the central area). The upper induction coil and the lower induction coil are away from each other in the longitudinal direction of the metal plate. Therefore, heating in a non-magnetic region of 750° C. or more can be performed.

TABLE 2

| | Selected oblique induction coil conductors | | Selected parallel-to-transverse-direction induction coil conductors | | (temperature at |
|---|---|---|---|---|---|
| | of upper induction coil | of lower induction coil | of upper induction coil | of lower induction coil | the edge area) − (temperature at the central area) |
| Example F | DEFJ | NOPQ | VWXYA'B' | J'K'E'F'H'I' | 4° C. |
| Example G | CDGH | MNQR | VWXYA'B' | J'K'E'F'H'I' | 18° C. |
| Example H | ABIJ | KLST | VWXYA'B' | J'K'E'F'H'I' | 75° C. |
| Example I | CDEFGH | MNOPQR | VWXYA'B' | J'K'E'F'H'I' | 6° C. |
| Example J | CDEFGH | MNOPQR | UVWXYZA' B'C' | D'E'F'G'H'I'J'K'L' | 10° C. |
| Example K | CH | MR | UVWXYZA' B'C' | D'E'F'G'H'I'J'K'L' | 50° C. |
| Example L | EF | OP | XWA' | F'J'I' | −6° C. |

Figure 28:
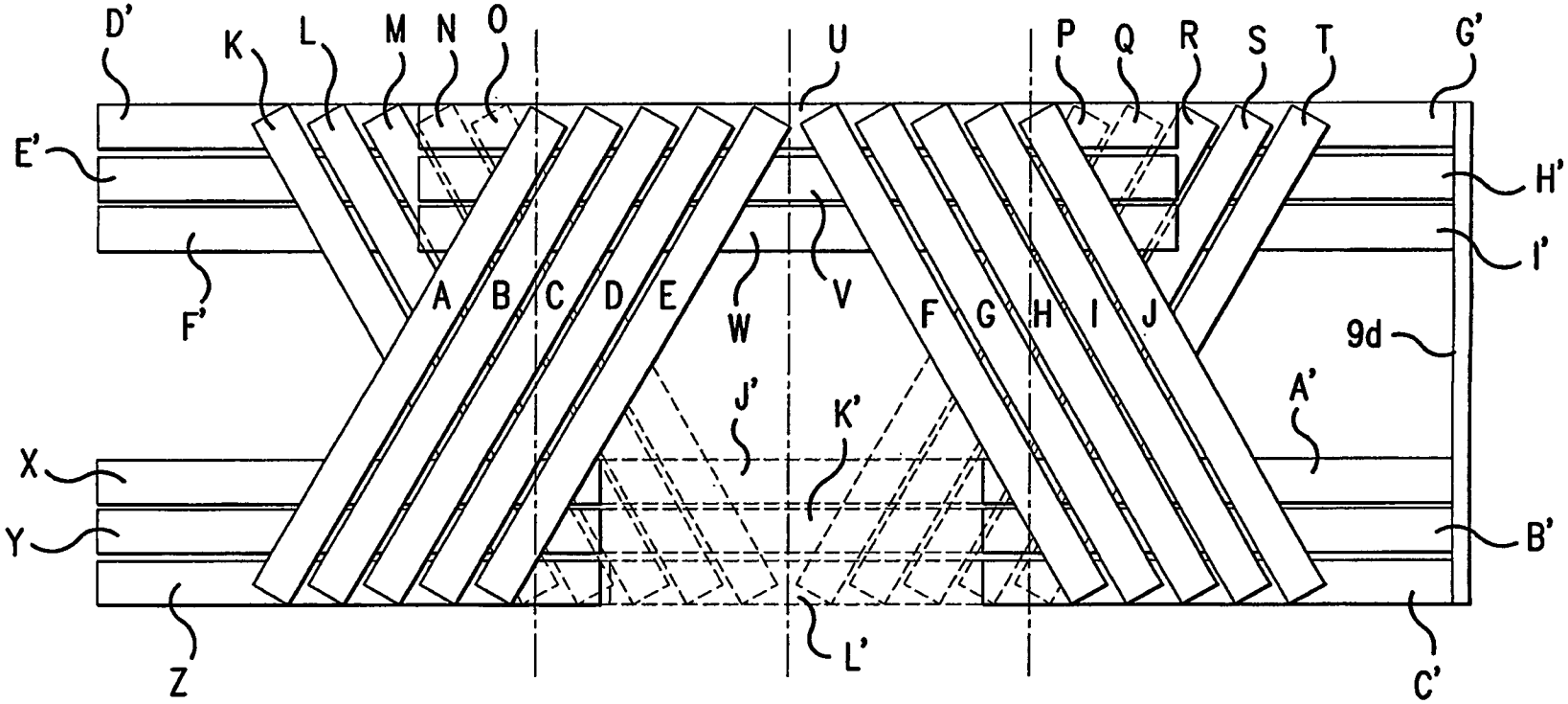
FIG. 28 is a schematic diagram of an embodiment of the present invention.

An induction coil shown in FIG. 28 was used for the test, where the AC power supply and the connection to the power supply are not shown. In FIG. 28, an upper induction coil includes a plurality of induction coil conductors A-J, each of which is made of a water-cooled copper plate (width: 50 mm, thickness: 10 mm) insulated and independent from each other and placed obliquely to the transverse direction of the steel plate to be heated (referred to as "the oblique induction coil conductors A-J"). Similarly, a lower induction coil includes a plurality of induction coil conductors K-T. Each of the induction coil conductors A-J of the upper induction coil can be (selectably) connected to the induction coil conductors U, V, W, X, Y, Z, A', B', C', each of which is also made of a water-cooled copper plate (width: 50 mm, thickness: 10 mm) and placed parallel to the transverse direction of the steel plate to be heated. (referred to as "the parallel-to-transverse-direction induction coil conductors U-C'"). The parallel-to-transverse-direction induction coil conductors U-C' are located closer to the steel plate to be heated relative to the oblique conductors (i.e., located below the oblique induction coil conductors A-J) and the electrical connection between any of the conductors U-C' and any of the conductors A-J are made by inserting a connecting copper plate between the selected combination of conductors. That is, the place where the connecting copper plate is inserted selects the conductors to be energized. A bakelite plate is inserted between the other unselected conductors and fastened with an insulated bolt. In the same fashion, each of the induction coil conductors K-T of the lower induction coil can be (selectably) connected to the induction coil conductors D', E', F', G', H', I', J', K', L', each of which is also made of a water-cooled copper plate (width: 50 mm, thickness: 10 mm) and placed parallel to the transverse direction of the steel plate to be heated.

In Example F, two parallel-to-transverse-direction induction coil conductors and two oblique induction coil conductors are selected both with respect to the upper and lower induction coils, where the upper and lower oblique conductors intersect (in terms of the projected images) at a position inside the width of the steel plate. In Example G, similarly to Example F, two parallel-to-transverse-direction induction coil conductors and two oblique induction coil conductors are selected. However, the upper and lower oblique conductors intersect (in terms of the projected images) over (in the vicinity of) the edge of the steel plate. In Example H, similarly to Examples F and G, two parallel-to-transverse-direction induction coil conductors and two oblique induction coil conductors are selected. However, the upper and lower oblique conductors intersect (in terms of the projected images) outside the edge of the steel plate. In Examples F, G and H, the selection of the conductors is made so that the distance between the upper and lower coils in the edge area of the steel plate becomes larger in turn from F to H.

As can be understood from the data "(the temperature at the edge area)-(the temperature at the central area)" in TABLE 2, the temperature distribution in the transverse direction is more uniform in Example F (where the upper and lower oblique conductors intersect at the position inside the width of the steel plate) than in Example H (where the upper and lower oblique conductors intersect outside the edge of the steel plate).

In Example I, two parallel-to-transverse-direction induction coil conductors and three oblique induction coil conductors are selected with upper and lower induction coils. In Example J, three parallel-to-transverse-direction induction coil conductors and three oblique induction coil conductors are selected with upper and lower induction coils. Since the current density in the central area is higher in Example I than in Example J, the heat divergence in the central area is larger in Example I than in Example J. As a result, "(the temperature at the edge area)-(the temperature at the central area)" is smaller in Example I than in Example J. However, the temperature at the edge area is still slightly overheated.

In Example K, three parallel-to-transverse-direction induction coil conductors and two oblique induction coil conductors are selected with upper and lower induction coils. In Example L, one parallel-to-transverse-direction induction coil conductor and two oblique induction coil conductors are selected with upper and lower induction coils. Since the current density in the central area is higher in Example L than in Example K, the heat divergence in the central area is larger in Example L than in Example K. As a result, "(the temperature at the edge area)−(the temperature at the central area)" is smaller in Example L than in Example K. However, the temperature at the edge area is still slightly overheated.

As described above, various temperature distributions can be realized by selecting the conductors and the number thereof.

Embodiment 3

An induction heating apparatus as shown in FIG. 17 or FIG. 18, both the upper and the lower induction coils have oblique portions which are located on the same side in the longitudinal direction of the metal plate to the transverse line of the metal plate and are roughly parallel to each other. Such an induction heating apparatus is used for heating metal plates having different widths. The same induction coil and the same AC power supply as in the above-described embodiment 1 were used, except for the oblique portion angle direction of the induction coil. The metal plates used were SUS304 steel plates having a 0.4 mm thickness and a width 800 mm and a width 600 mm. The traveling speed of the steel plate was 2 m/min. The gap between the steel plate and the induction coil was 50 mm.

In Examples M and N, a distance between the upper and lower induction coils was set to 200 mm in the central area, and a distance at the edge area when an 800 mm steel plate was used was 170 mm in Example M (corresponding to FIG. 17) and 250 mm in Example N (corresponding to FIG. 18). The edge area temperature was measured at a position 50 mm away from the edge of the steel plate. The results are shown in TABLE 3.

TABLE 3

| | Displacement in the central area [mm] | Displacement in the edge area [mm] | {(temperature at the edge area) − (temperature at the central area)} of 800 mm width steel | {(temperature at the edge area) − (temperature at the central area)} of 600 mm width steel |
|---|---|---|---|---|
| Example M | 200 | 170 | −5° C. | −2° C. |
| Example N | 200 | 250 | 32° C. | 21° C. |

In Example M, since the distance at the edge area is smaller than in the central area, the temperature in the edge area can be generally lowered relative to that in the central area. In the case of the 600 mm width steel plate, the distance at the edge area (measurement point is 50 mm away from the edge of the steel plate) is relatively larger to that in the case of the 800 mm width steel plate, which leads to a longer heating time and a relative increase in temperature at the edge area. On the contrary, in Example N, where the distance at the edge area becomes larger than in the central area, the heat divergence also becomes relatively larger, which leads to a higher temperature at the edge area relative to that in the central area.

As described above, the present invention is capable of heating a metal plate with high efficiency, even where the temperature of the metal plate is high above the Curie point, the metal plate is thin and/or the metal plate is made of a non-magnetic non-ferrous metal with a low specific resistance such as aluminum or copper. Also, the present invention is capable of providing a metal plate with a flatter temperature distribution in the width direction independently of any preexisting initial temperature distribution provided by a previous process. The present invention can make it easier to control an amount of heat divergence according to an initial temperature condition of the metal plate to be heated and/or realize a desired temperature distribution even when the width of metal plate to be heated is changed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An induction heating apparatus for heating a metal plate, comprising:

an induction coil including an upper portion and a lower portion located below the upper portion so that the upper portion and lower portion are spaced from one another in a first direction, said upper and lower portions of the induction coil being spaced from each other in a conveying direction at a first position of the induction coil across a transverse direction, and, at a second position of the induction coil, lengths of the upper and lower portions of the induction coil overlap along the lengths, the transverse direction being perpendicular to the first direction, wherein a distance, in the conveying direction between the upper portion and the lower portion of the induction coil varies across the transverse direction, and wherein said second position of the induction coil, where the upper and lower portions of the induction coil overlap, is a peripheral portion of the induction heating apparatus in top plan view in the transverse direction, induced currents of the upper and lower coil portions thus canceling each other in a portion of the metal plate in the case that the portion of the metal plate travels between the overlapping lengths of the upper and lower coil portions.

2. The induction heating apparatus according to claim 1, wherein the overlapping portion of the induction coil extends parallel to the transverse direction.

3. An induction heating apparatus, comprising:

an upper induction coil portion and a lower induction coil portion, the upper induction coil portion having a first substantially uniform coil width which, is positioned across a transverse direction at a first uniform distance above the lower induction coil portion, the upper induction coil portion being configured to inductively heat at least a non-edge portion of a top surface of a metal plate traveling under the upper induction coil portion; and the lower induction coil portion having a second substantially uniform coil width, the lower induction coil portion being configured to inductively heat at least a non-edge portion of a bottom surface of the metal plate, wherein the upper and lower induction coil portions, when seen in a top plan view, are spaced apart from each other in a conveyance direction at a first position, a distance of the space varying across the transverse direction, and wherein the induction coil portions overlap along a length of the induction coil portions at a peripheral portion of the induction coil portions, the overlapping length being in the transverse direction, induced currents of the upper and lower induction coil portions thus canceling each other in a portion of the metal plate in the case that the portion of the metal plate travels between the overlapping length of the upper and lower induction coil portions.

4. The induction heating apparatus according to claim 3, wherein the first uniform coil width is different from the second uniform coil width.

5. An induction heating apparatus for heating a metal plate traveling through a conveyance area of the heating apparatus, comprising:

a metal plate, the metal plate having two side edges; and an induction coil having a conveyance area, said induction coil including an upper portion for being located above the conveyance area and a lower portion for being located below the conveyance area, said upper and lower portions of the induction coil being spaced from each other in a conveying direction of the conveyance area at a first position of the induction coil across a transverse direction, and, at a second position of the induction coil, lengths of the upper and lower portions of the induction coil overlap along the lengths, wherein a distance, in the conveying direction of the conveyance area, between the upper portion and the lower portion of the induction coil varies across the conveyance area, wherein said conveyance area extends between the upper portion and lower portion and the two side edges of the metal plate, wherein said second position of the induction coil, where the upper and lower portions of the induction coil overlap, is a peripheral portion of the induction heating apparatus and is situated to correspond to an edge of or is outside the conveyance area in top plan view in the transverse direction, induced currents of the upper and lower coil portions thus canceling each other in a portion of the metal plate in the case that the portion of the metal plate travels between the overlapping lengths of the upper and lower induction coil portions, and wherein the upper and lower portions of the induction coil overlap at each side edge of the metal plate.

6. An induction heating apparatus, comprising:

a metal plate, the metal plate having two side edges and a conveyance path; and an upper induction coil portion having a first substantially uniform coil width which, when viewed in a direction of conveyance of the conveyance path of the induction heating apparatus, is positioned across the conveyance path at a first uniform distance above the conveyance path, the upper induction coil portion being configured to inductively heat at least a non-edge portion of a top surface of the metal plate traveling on the conveyance path under the upper induction coil portion; and a lower induction coil portion having a second substantially uniform coil width which, when viewed from the direction of conveyance of the conveyance path, is positioned across the conveyance path at a second uniform distance beneath the conveyance path, the lower induction coil portion being configured to inductively heat at least a non-edge portion of a bottom surface of the traveling metal plate, wherein the upper and lower induction coil portions, when seen in a top plan view, are spaced apart from each other in the direction of conveyance at a first position, a distance of the space varying across the conveyance path, and at or outside an edge of the conveyance path the coil portions overlap along a length of the coil portions at a peripheral portion of the coil portions, the overlapping length being in a direction transverse to the direction of conveyance, induced currents of the upper and lower induction coil portions thus canceling each other in a portion of the metal plate in the case that the portion of the metal plate travels between the overlapping length of the upper and lower induction coil portions, wherein the upper and lower induction coil portions of the induction coil overlap at each side edge of the metal plate.

* * * * *